US005465549A

United States Patent [19]

Lummus

[11] Patent Number: 5,465,549

[45] Date of Patent: Nov. 14, 1995

[54] APPARATUS FOR APPLYING TWIST TIES

[75] Inventor: Charles L. Lummus, Plano, Tex.

[73] Assignee: Lummus Investment Corporation, Plano, Tex.

[21] Appl. No.: 135,688

[22] Filed: Oct. 12, 1993

Related U.S. Application Data

[63] Continuation-in-part of Ser. No. 129,603, Sep. 30, 1993, abandoned.

[51] Int. Cl.[6] ..... B65B 51/08

[52] U.S. Cl. ..... 53/138.8; 53/69; 53/75; 53/76; 53/77; 53/138.7; 53/505

[58] Field of Search ..... 493/12, 31, 32, 493/33; 53/138.6, 138.7, 138.8, 505, 506, 52, 56, 64, 67, 69, 75, 76, 77

[56] References Cited

U.S. PATENT DOCUMENTS

| | | | |
|---|---|---|---|
| 2,725,168 | 11/1955 | Lindstaedt et al. . | |
| 2,780,898 | 2/1957 | Weingart et al. | 53/138.8 X |
| 2,821,055 | 1/1958 | Platt et al. . | |
| 2,840,967 | 7/1958 | Platt et al. . | |
| 2,915,171 | 12/1959 | Peck . | |
| 2,934,869 | 5/1960 | Engleson et al. | 53/67 |
| 3,225,507 | 12/1965 | Cory . | |
| 3,261,143 | 7/1966 | Platt et al. . | |
| 3,283,474 | 11/1966 | Bower . | |
| 3,369,573 | 2/1968 | Baket et al. . | |
| 3,481,106 | 12/1969 | Tetrick . | |
| 3,518,807 | 7/1970 | Pitkanen . | |
| 3,584,545 | 7/1971 | Ehlscheid | 493/12 |
| 3,648,432 | 3/1972 | Zellmer et al. . | |
| 3,721,061 | 3/1973 | Bodolay | 53/138.8 |
| 3,783,585 | 1/1974 | Hoyland . | |
| 3,864,894 | 2/1975 | Sheetz et al. | 53/506 |
| 3,919,829 | 11/1975 | Burford et al. . | |
| 3,983,681 | 10/1976 | Britt et al. | 53/76 |
| 4,005,563 | 2/1977 | Nitsch . | |
| 4,513,558 | 4/1985 | Treiber | 53/389.2 X |
| 4,534,149 | 8/1985 | Hoyland . | |
| 4,559,754 | 12/1985 | Bacon | 53/138.7 X |
| 4,593,515 | 6/1986 | Margraf | 53/56 |
| 4,621,479 | 11/1986 | Hoyland . | |
| 4,730,434 | 3/1988 | Knudsen . | |
| 4,809,481 | 3/1989 | Fruh et al. . | |
| 4,856,258 | 8/1989 | Burford et al. | 53/138.8 |
| 4,907,392 | 3/1990 | Knudsen . | |
| 5,121,682 | 6/1992 | Parker et al. | 53/138.8 X |

FOREIGN PATENT DOCUMENTS

| | | | |
|---|---|---|---|
| 938822 | 12/1973 | Canada | 493/33 |

*Primary Examiner*—John Sipos
*Assistant Examiner*—Daniel Moon
*Attorney, Agent, or Firm*—Michael A. O'Neil

[57] ABSTRACT

Apparatus for applying twist ties comprises structure for receiving the open end of the film wrapper of a bakery product; structure for severing the leading end from a length of ribbon to form a twist tie; and structure for twisting the twist tie around the end of the film wrapper, thereby closing same. A naked loaf detector and a hook jam detector are provided. All operations of the apparatus are controlled by a programmable logic controller.

4 Claims, 31 Drawing Sheets

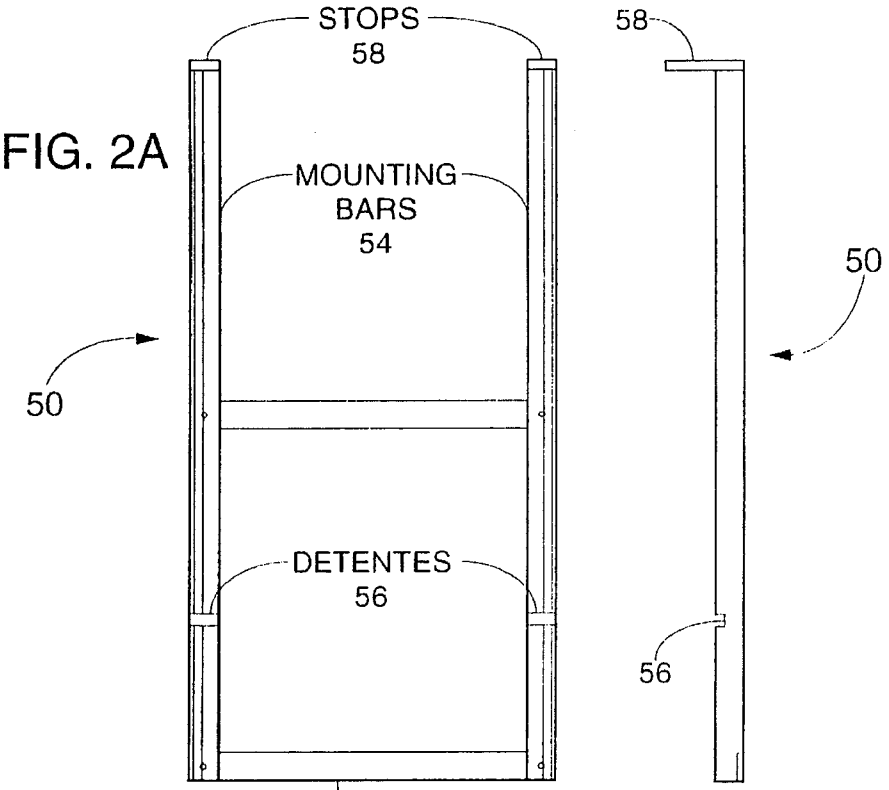
FIG. 2C
FIG. 2A
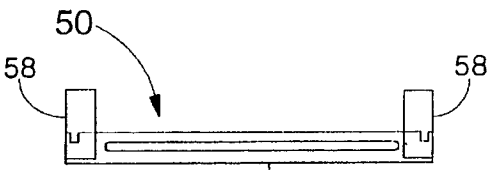
FIG. 2B
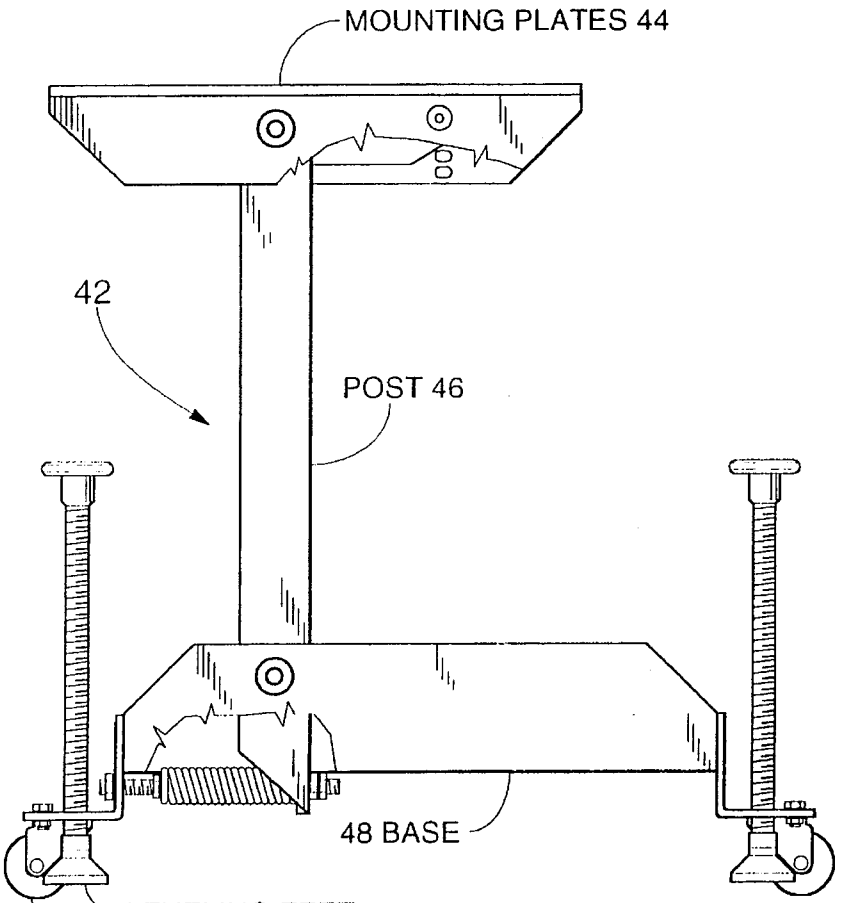
FIG. 1

REAR VEIW OF CONTROL BOX

SECTION "B-B"

(ELECTRICAL CONNECTIONS)

SECTION "A-A"

APPARATUS FOR APPLYING TWIST TIES

RELATED APPLICATION

This application is a continuation-in-part of application entitled "Apparatus for Applying Twist Ties," filed Sep. 30, 1993, Ser. No. 08/129,603 now abandoned.

TECHNICAL FIELD

This invention relates generally to an apparatus for applying twist ties to the film wrappers commonly used to protect and preserve bakery products.

BACKGROUND AND SUMMARY OF THE INVENTION

In the manufacture of bakery products, such as bread, rolls, and the like, the products are typically baked, and are thereafter cooled. Particularly in the case of bread, the next manufacturing step may comprise slicing. Ultimately, the bakery products are almost always wrapped, usually in a film bag, which serves to protect the products during transportation from the bakery to the consumer, and thereafter to preserve the freshness of the products until they are finally consumed.

The use of twist ties as the closure mechanism for the film wrappers of bakery products is advantageous in that it allows repeated opening and reclosing of the wrappers as the products are gradually consumed. U.S. Pat. No. 4,907,392 granted Mar. 13, 1990, to Knudsen, which is incorporated herein by reference as if fully set forth herein, discloses a Machine for Applying Twist-Type Ties to the film wrappers of bakery products. The present invention comprises an apparatus for applying twist ties which is similar in some respects to the Knudsen device, but which is faster, more accurate, and more reliable in operation. The apparatus of the present invention is an "on-demand" device for applying twist ties as air-tight closures to bagged bakery products in high-speed production line conditions.

The apparatus is unique in its flexibility to satisfy a wide variety of production situations, while requiring minimum maintenance. This flexibility has several sources:

1. The apparatus has no mechanical connections to its associated bagging machine. There is, however, one simple electrical connection for an interlock necessary to enable coordination between the bagger and the apparatus of the present invention.

2. Timing is controlled by a Programmable Logic Controller (PLC) to 1/100 second accuracy.

3. The PLC enables available fault logic unachievable in any mechanical machine, thus guaranteeing good ties with every tying cycle.

4. The apparatus can be easily and quickly moved from one bagger to another, with little or no adjustment required.

5. The apparatus can tie products faster than any machine available, because it makes no reciprocal motions—all motion is forward. But it can also tie slowly. The apparatus has been production tested at conveyor speeds from 30 fpm to 105 fpm.

6. The apparatus can tie products from conveyors with any flight spacing, variable spacing, or no flights at all.

7. The apparatus can tie products at varying conveyor speeds, with the mere setting of a switch.

8. The apparatus is manufactured with long-wearing, rust and corrosion resistant materials and components, and with a minimum of moving parts. The result is virtually no maintenance.

The apparatus for applying twist ties of the present invention differs from the similar apparatus disclosed in the above-identified Knudsen patent in three fundamental aspects. First, all of the operations of the apparatus of the present invention are under control of the PLC.

Second, rather than using the gear train of the Knudsen device to transfer motion from the drive motor to the various drive shafts and to control the timing of the several components of each operating cycle, the apparatus of the present invention utilizes a drive train comprising a drive motor, a drive pulley driven by the drive motor, a drive belt driven by the drive pulley, and three driven pulleys each continuously operated under the action of the drive motor, the drive pulley, and the drive belt. A partial revolution clutch is associated with each of the driven pulleys and functions upon actuation by the PLC to connect the drive shafts of the pusher pad assembly, the needle assembly, and the twister hook assembly, respectively, to their respective driven pulleys for actuation thereby.

Third, the apparatus for applying twist ties of the present invention employs photosensors to detect the presence of unwrapped product (such apparatus being referred to as the "naked loaf" detector) and to detect the presence of foreign objects in the area of the twister hook at a time in the operating cycle of the apparatus when no foreign objects should be present in such area to determine fault conditions. Upon determination of any such fault condition, the PLC functions not only to terminate operation of the present apparatus, but also to terminate operation of the associated conveyors and product bagging apparatus, thereby preventing the excessive loss of product which has sometimes been characteristic of the use of prior art apparatus.

DESCRIPTION OF THE DRAWINGS

A more complete understanding of the present invention may be had by reference to the follow Detailed Description when taken in conjunction with the accompanying Drawings, wherein:

FIG. 1 is an illustration of a stand useful in supporting the apparatus of the present invention;

FIG. 2A is an illustration of a mounting bracket for the apparatus of the present invention;

FIG. 2B is an end view of the mounting bracket of FIG. 2A;

FIG. 2C is a side view of the mounting bracket of FIG. 2A;

DETAILED DESCRIPTION

Figure 3:
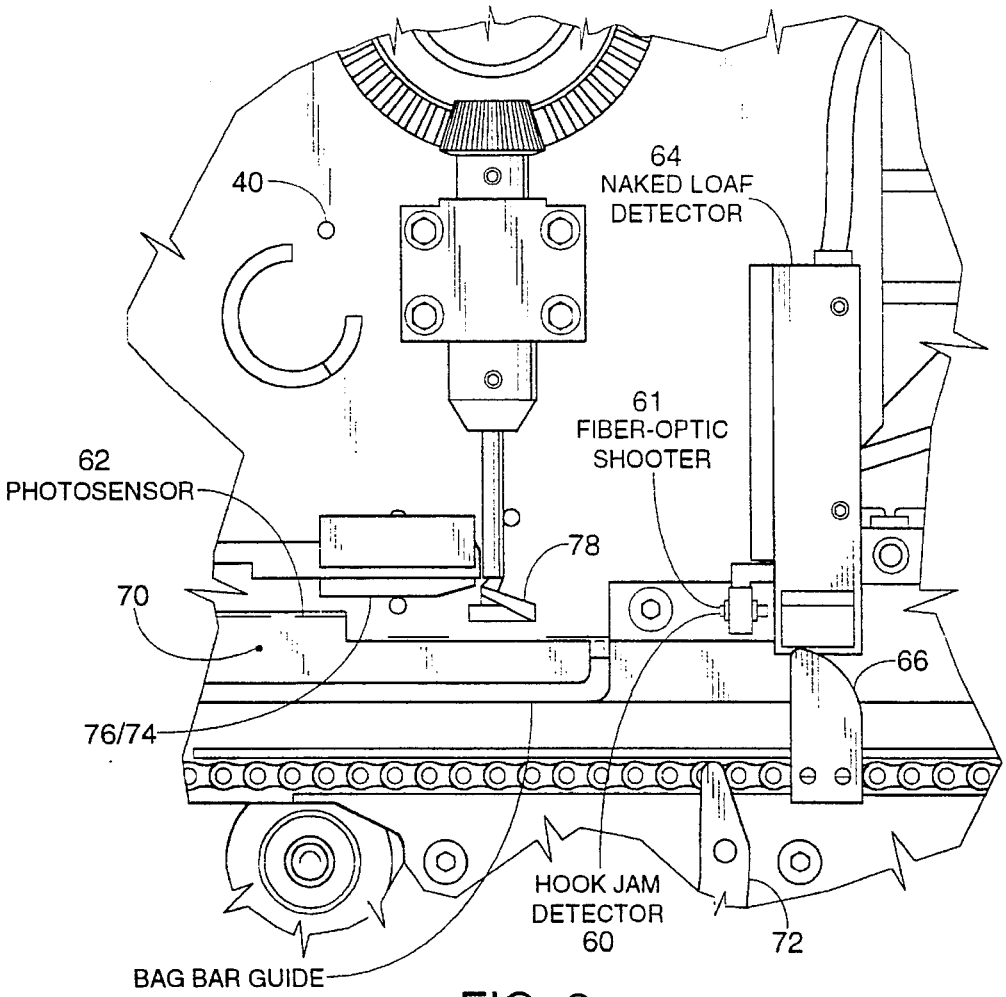
FIG. 3 is an illustration of a portion of the apparatus of the present invention including specifically the naked loaf detector and the hook jam detector components thereof.

Referring now to the Drawings, wherein like reference numerals designate like components throughout the several views, there is shown an APPARATUS FOR TYING TWIST TIES 40 comprising the present invention.

As is best shown in FIG. 1, installation, operation, and relocation of the apparatus 40 are facilitated by use of a STAND 42. The stand 42 consists of three parts:

1. the pre-drilled MOUNTING PLATES 44, holding the apparatus 40 firmly and level against the conveyor;

2. the POST 46, which can be tilted away from the conveyor carrying the bagged product, for ease and speed in 'threading' ribbon into the apparatus 40;

3. the BASE 48, which has casters for easy transportation when locating or relocating the apparatus 40. The base 48 also has four self-leveling feet on threaded posts, enabling the apparatus 40 to be adjusted to a stable position at various conveyor heights.

Certain bakers may prefer to mount the apparatus 40 directly on the structure of their bagging machine. In these instances, the MOUNTING FRAME 50 shown in FIGS. 2A, 2B, and 2C, may fit adequately, or may be modified to precise dimensional specifications.

The mounting frame 50 features: (1) a SLOTTED BRACKET 52 for attachment to the conveyor; (2) two MOUNTING BARS 54, with tracks in which the apparatus 40 can roll when necessary to move it away from the conveyor for easy threading or re-threading ribbon; (3) slot DETENTES 56 in the mounting bars 54 to hold the apparatus 40 in position against the conveyor during tying operations; (4) STOPS 58 to halt the apparatus 40 when it is rolled back away from the conveyor for threading.

Referring to FIG. 3, the HOOK JAM DETECTOR 60 includes a fiber-optic shooter 61 and a fiber-optic photosensor 62. The hook jam detector 60 detects a 'jam' (a bag neck wrapped around the hook) or any plastic or ribbon debris left on the hook after a tying cycle. Such a jam or debris will prevent an acceptable tie at the next cycle. Therefore, the detection of a hook jam fault stops the apparatus 40 and the bagger, and will not allow reset until the jam is cleared.

The NAKED LOAF DETECTOR 64 is a photosensor that detects an unbagged product passing in front of it. The naked loaf detector 64 stops both the apparatus 40 and the bagging machine to save product from being wasted, and to allow the operator to clear away the unbagged product and correct any problem with the bagger. Restart of the bagger also restarts the apparatus 40.

Figure 28:
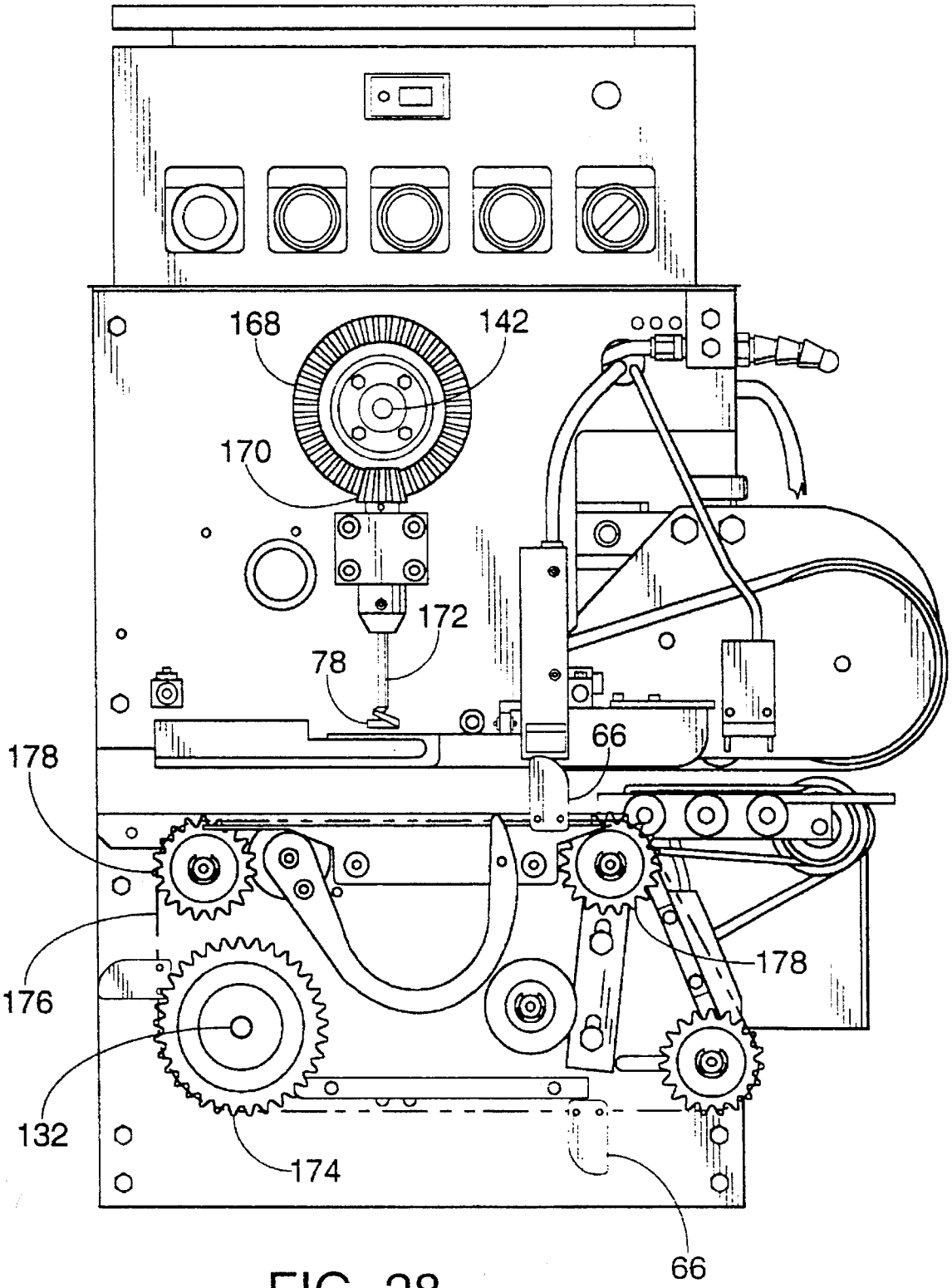
FIG. 28 is a detailed front view of the apparatus for applying twist ties of the present invention.
Figure 29:
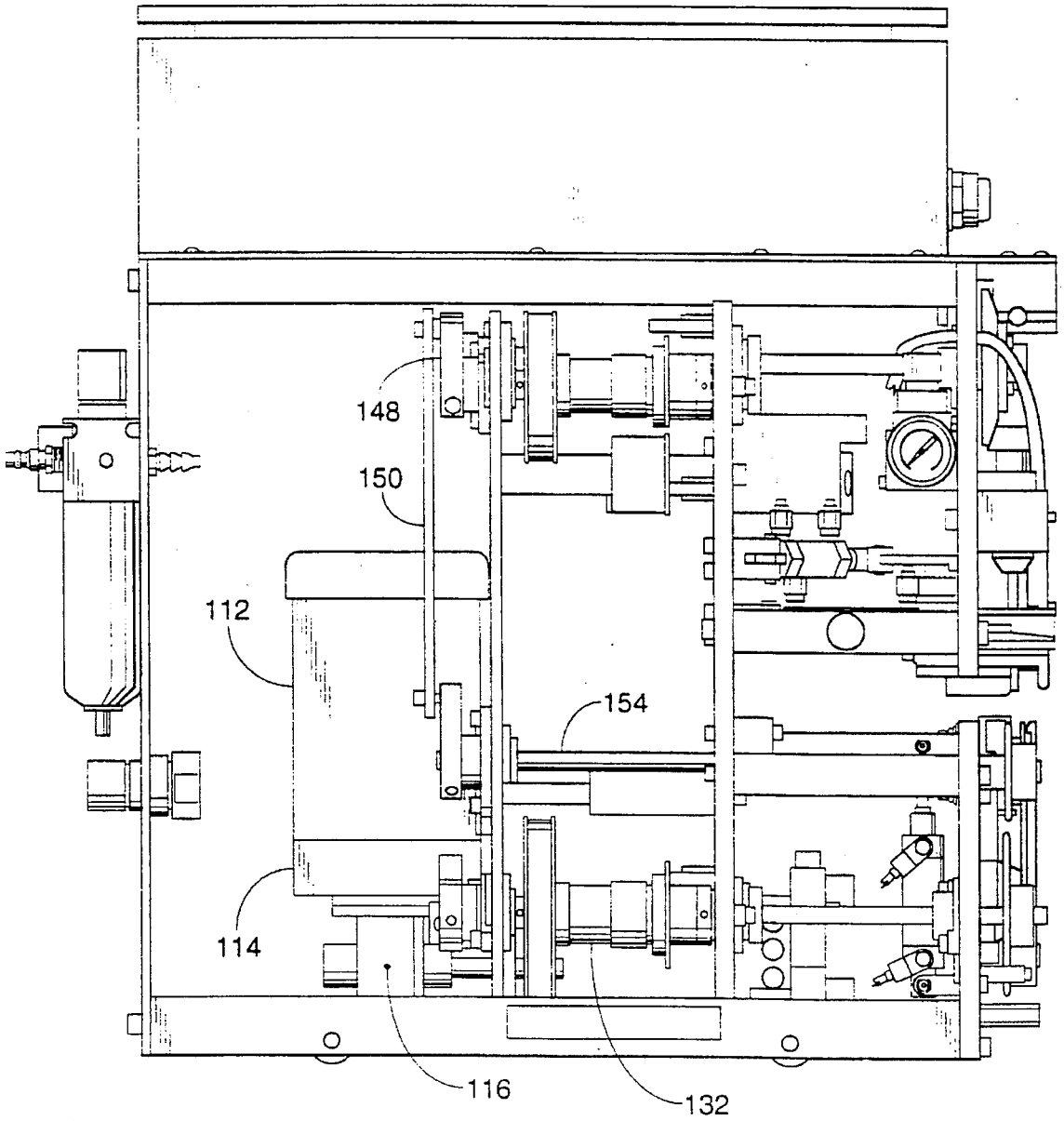
FIG. 29 is a detailed left side view of the apparatus for applying twist ties of the present invention.
Figure 30:
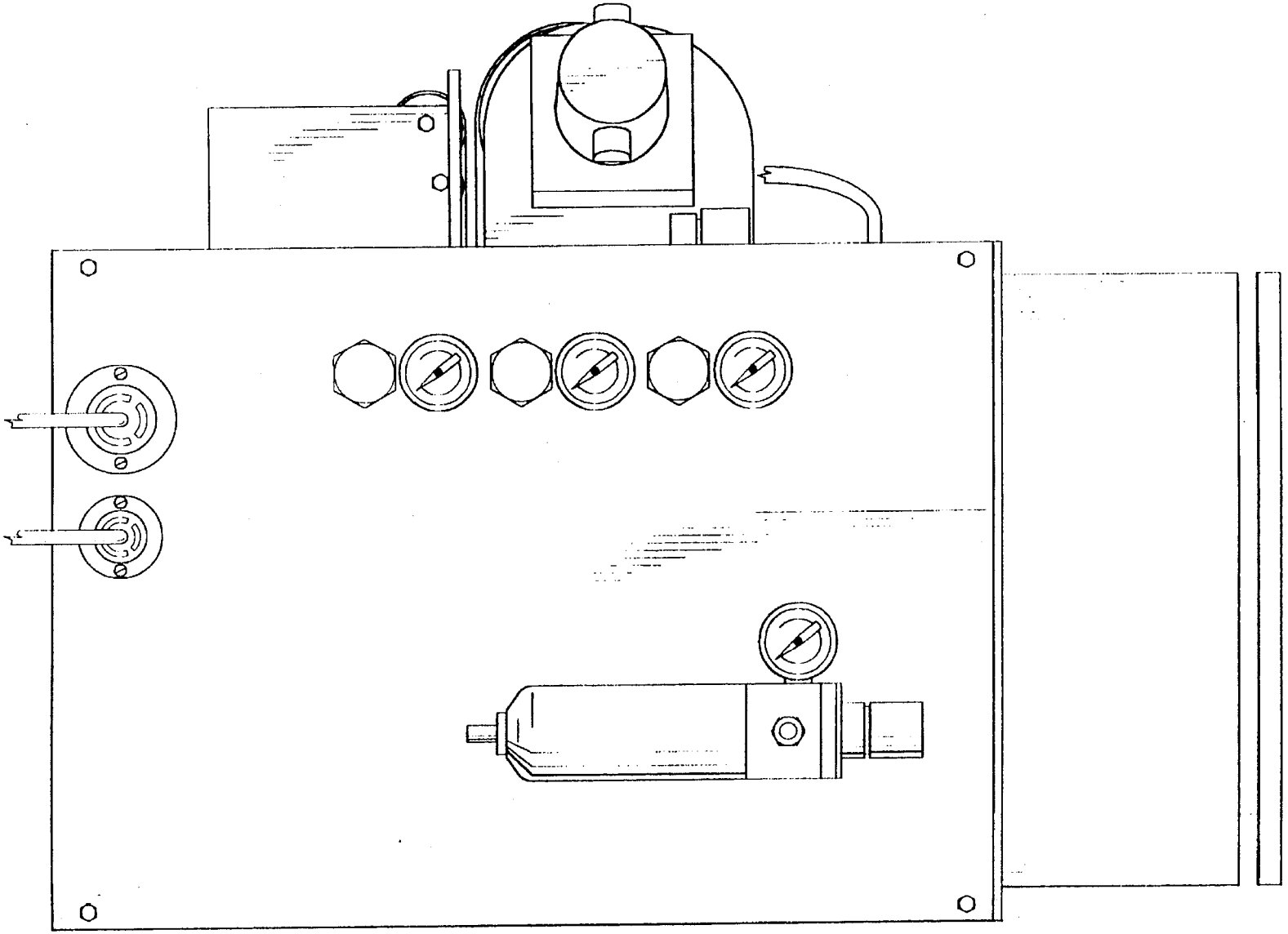
FIG. 30 is a back view of the apparatus of the present invention.
Figure 31:
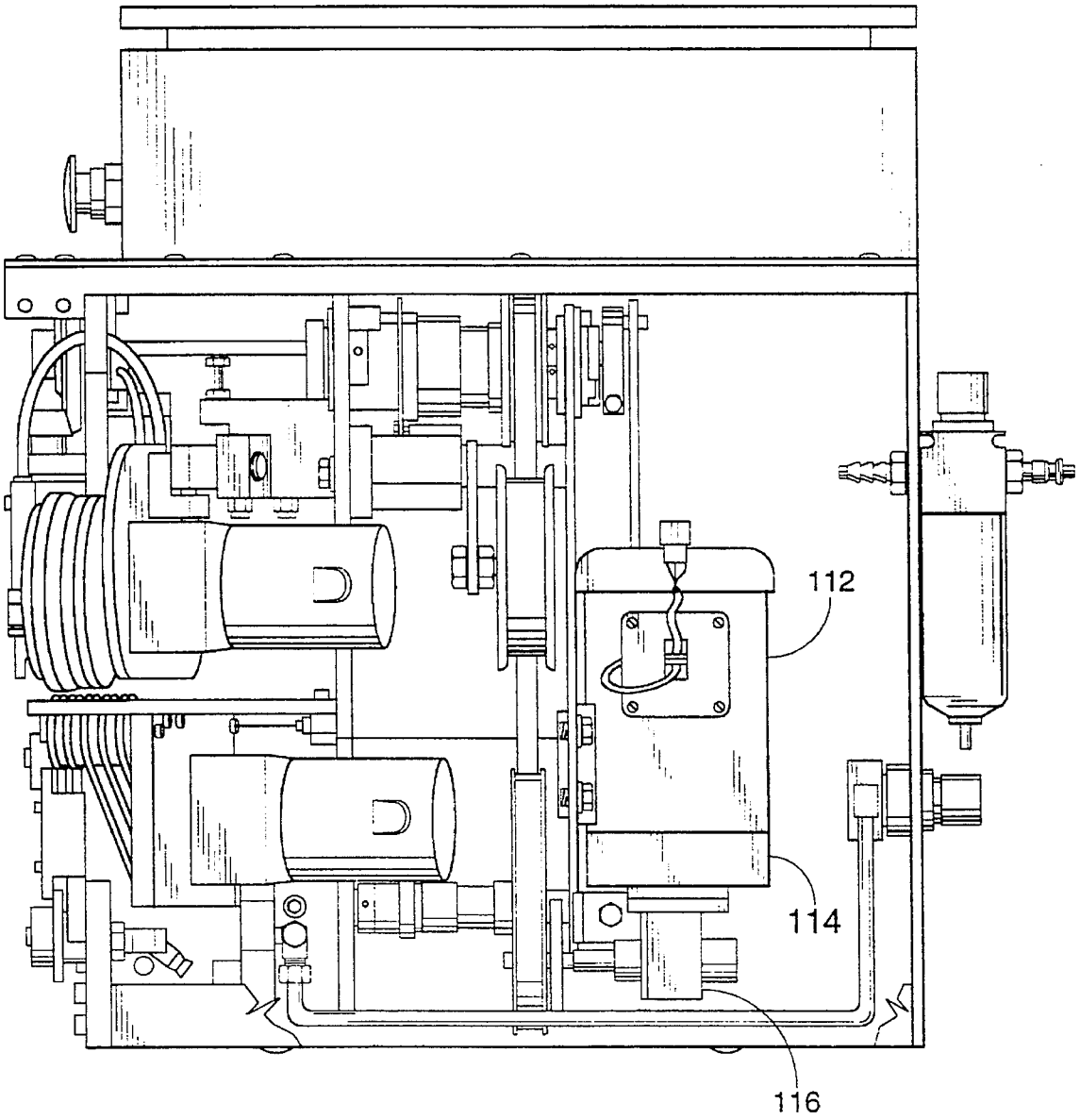
FIG. 31 is a detailed right side view of the apparatus of the present invention.

Referring to FIG. 28, the apparatus 40 uses a PHOTO-OPTIC BAG PRESENT SENSOR 65 to detect the presence of a bag, even clear plastic. This detection initiates a tying cycle, completed under timed control of the PLC. Failure to detect the presence of a bag generates a fault signal which terminates operation of the apparatus.

Figure 14:
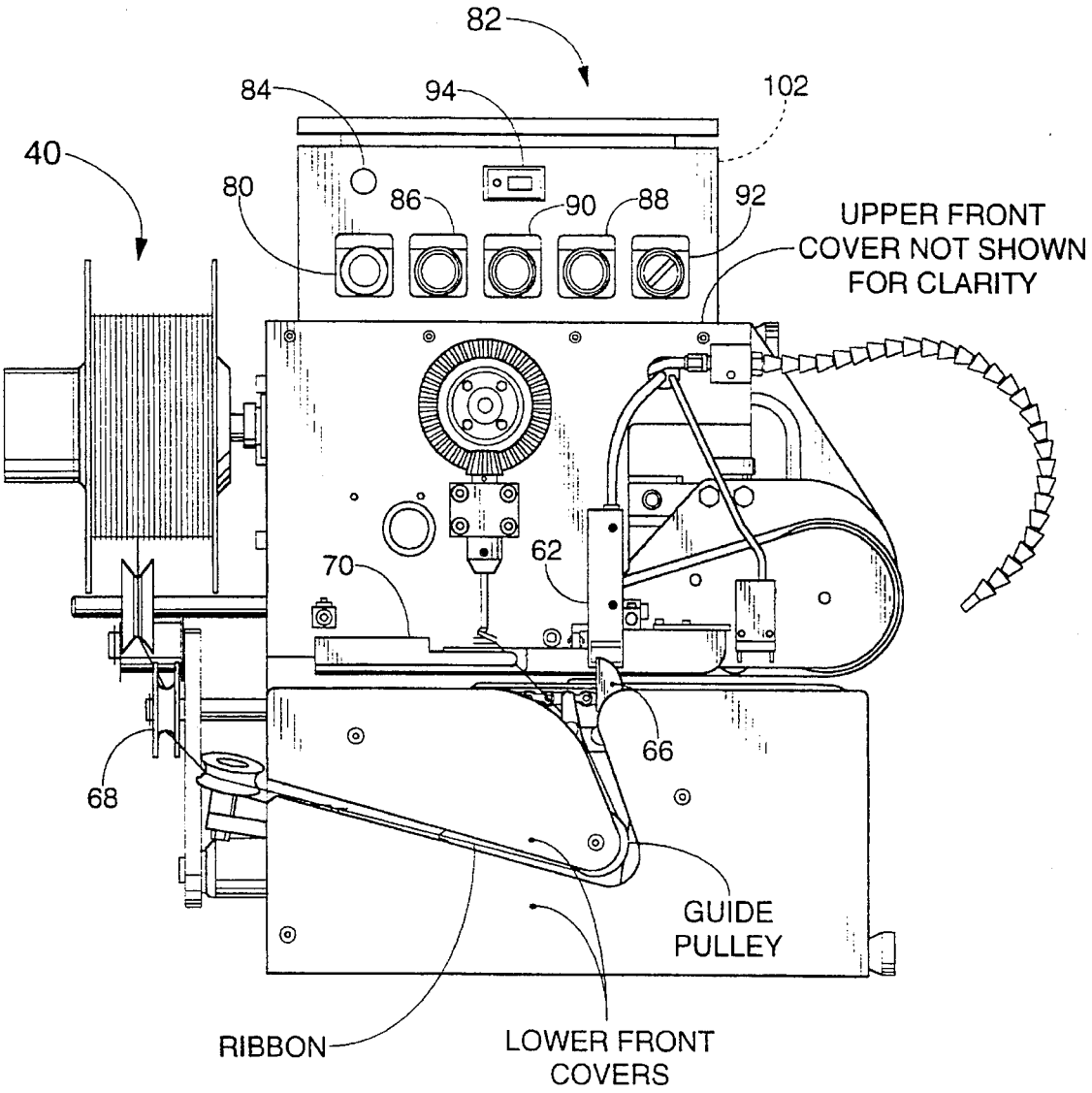
FIG. 14 is a front view of the apparatus of the present invention.
Figure 15:
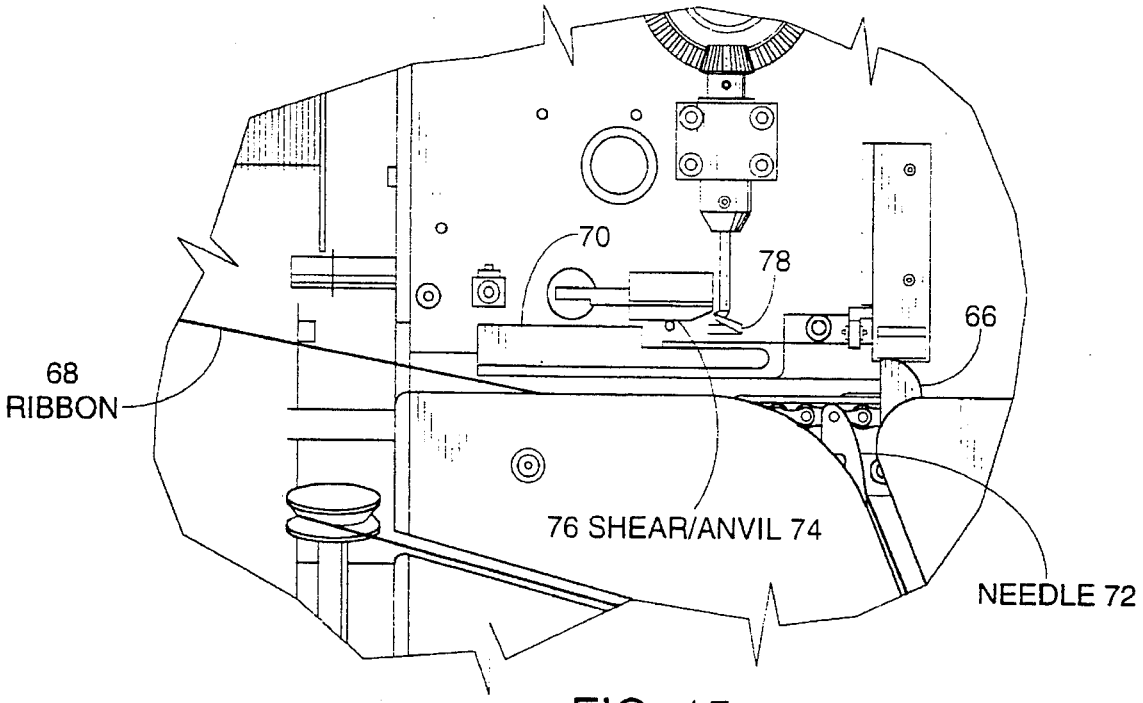
FIG. 15 is an enlargement of a portion of FIG. 14 illustrating certain components of the present invention.
Figure 16:
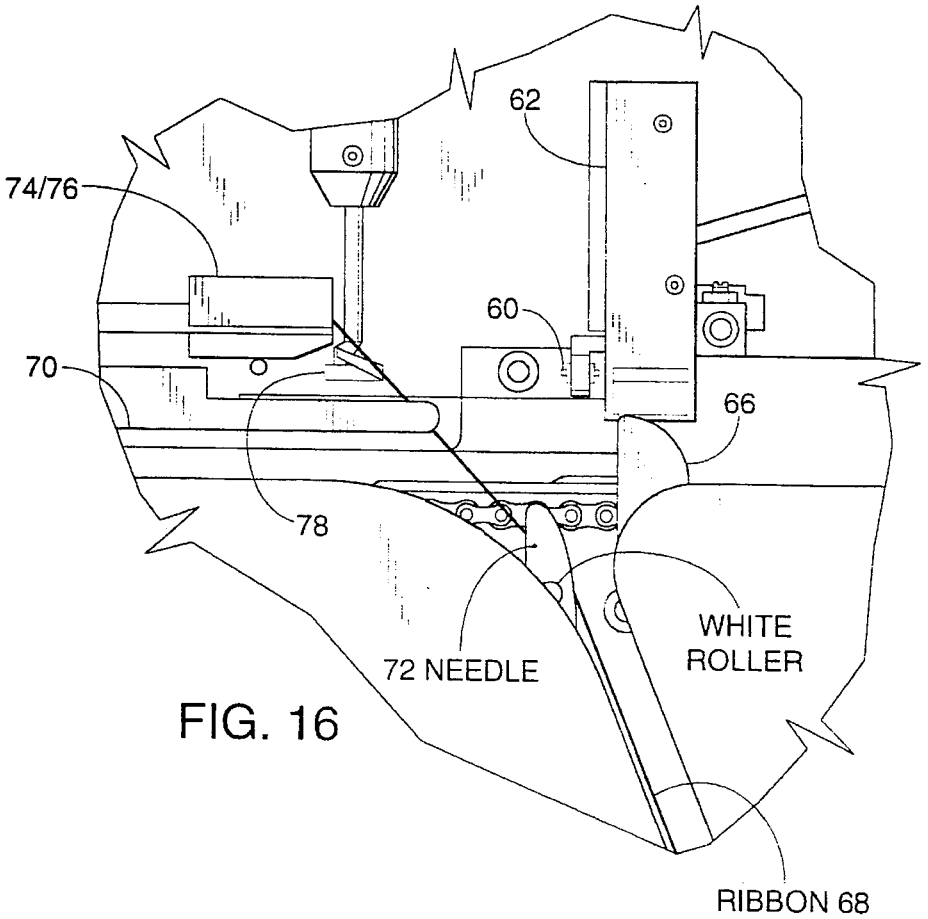
FIG. 16 is an enlargement of a portion of FIG. 14 further illustrating certain components of the apparatus of the present invention.
Figure 19A:
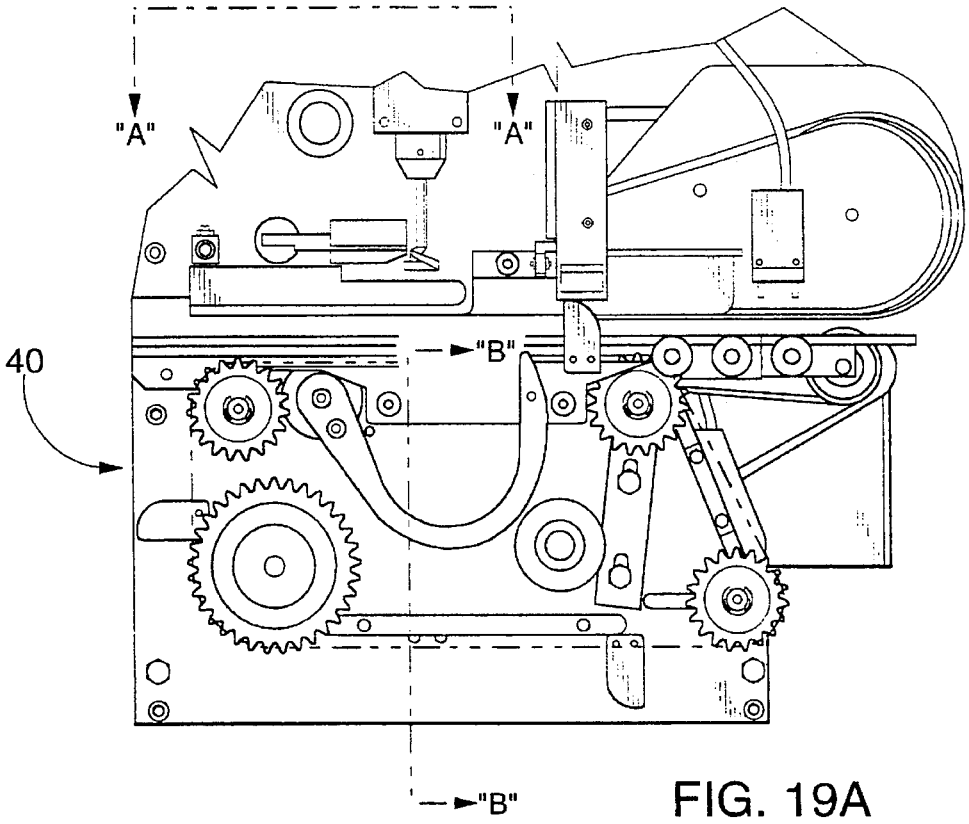
FIG. 19A is a view similar in some respects to FIG. 18 illustrating the operating components of the apparatus of the present invention.
Figure 19B:
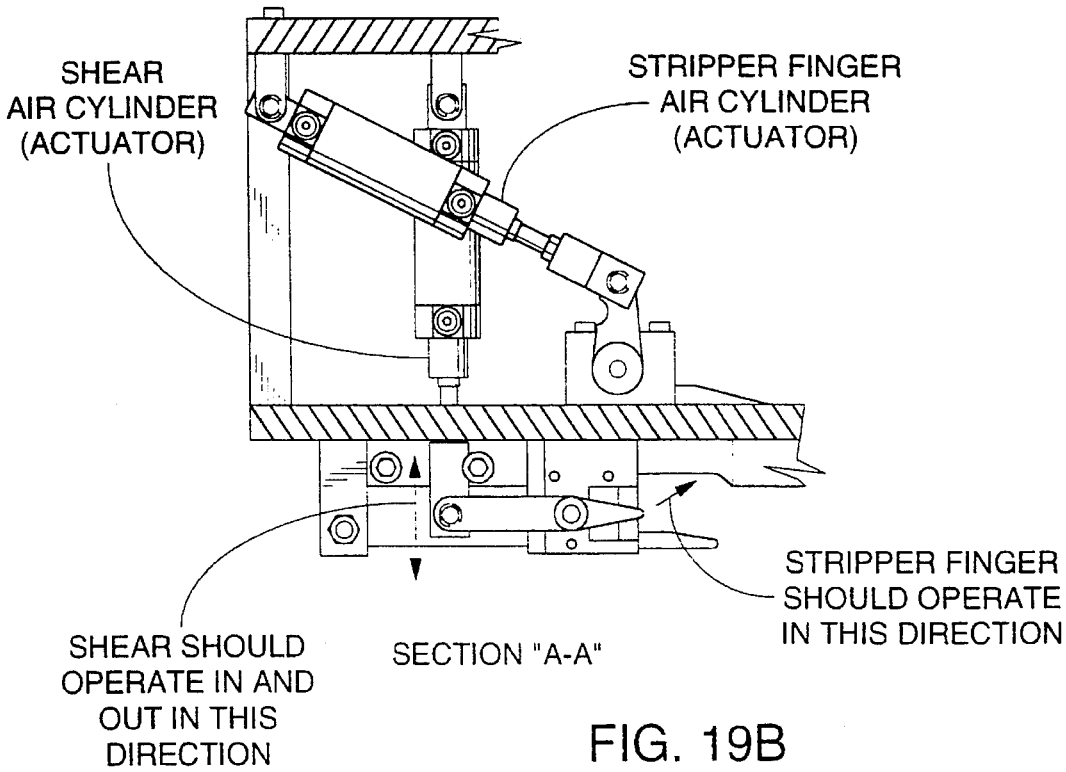
FIG. 19B is a view taken along the lines A—A of FIG. 19A.
Figure 19C:
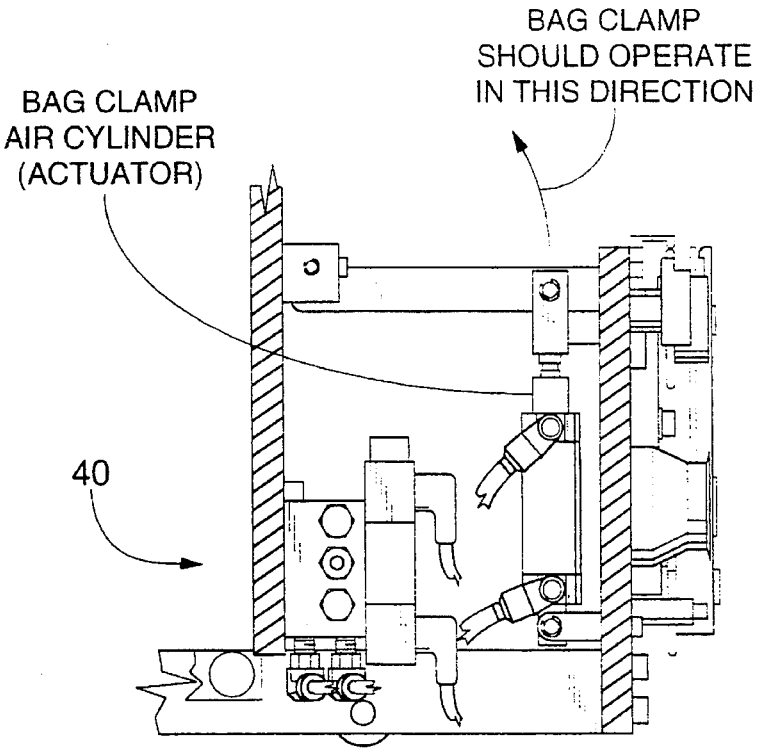
FIG. 19C is an illustration taken along the lines B—B of FIG. 19A.

Referring to FIGS. 14, 15 and 16, a PUSHER PAD 66 gathers the bag neck against the RIBBON 68; then the BAG CLAMP 70 (FIG. 19C) holds the bag tightly, so as to keep it from being pulled into the hook; next the NEEDLE 72 loops the tying ribbon over the gathered bag neck and positions it within the ANVIL 74; the SHEAR 76 then cuts the ribbon 68 against the LEDGER, simultaneously clamping the 'supply' end of the ribbon against the anvil 74; the TWISTER HOOK 78 makes four revolutions, completing the twist tie; at this instant, the STRIPPER FINGER clears the tied ribbon and bag neck from the hook and shear 76; almost simultaneously, the pusher pad 66 again moves forward, pushing the tied product free of the apparatus 40, onto the product conveyor. The operation of the pusher pad 66, the ribbon 68, the bag clamp 70, the needle 72, the anvil 74, the shear 76 and the twister hook 78 as described in this paragraph are identical to the operation of the same components comprising the apparatus shown and described in Knudsen, U.S. Pat. No. 4,907,392, the disclosure of which is incorporated herein by reference.

All of these events occur in slightly more than ½ second. Seven timing or position sensors monitor the operation, assuring completion of a good tie, but shutting the apparatus 40 and the bagger off if an error occurs. Timing can be easily tailored to any particular production situation.

Figure 4:
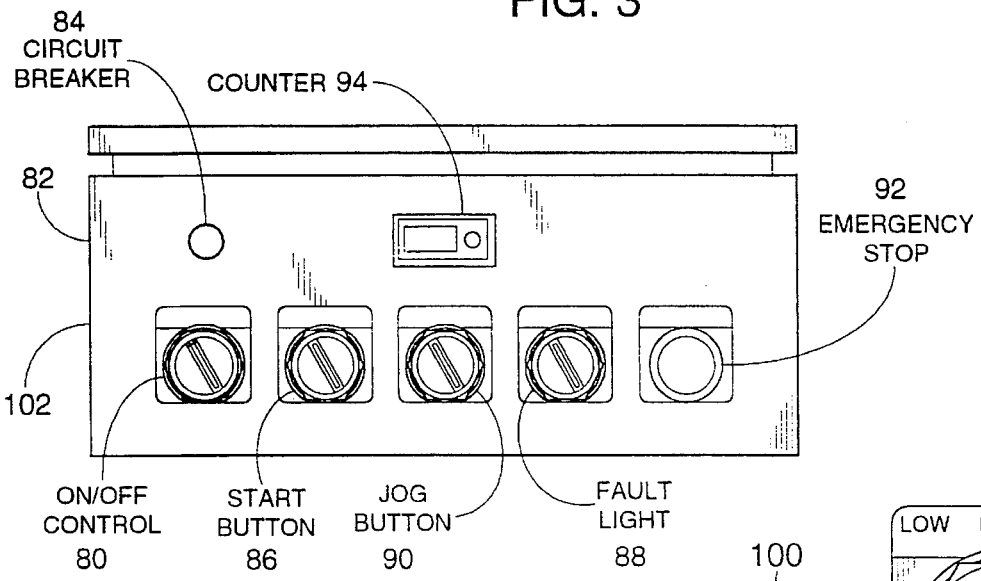
FIG. 4 is an illustration of the control panel of the apparatus of the present invention.

As is shown in FIG. 4, the MAIN POWER SWITCH 80 (a simple ON/OFF directional switch) is located on the front of the CONTROL BOX 82. A 3-amp pop-out CIRCUIT BREAKER 84 is located above the power switch 80. It protects the main drive motor from voltage surges that might occur.

The green START/RESET BUTTON 86, on the front of the control box 82, must be depressed (its lamp illuminates) after the power switch 80 is turned to ON. The start/reset button 86 actuates the infeed motor, turning the infeed belts to take a bag into the apparatus 40. The start/reset button 86 causes no other action by itself, but simply puts the apparatus 40 into a "ready state" so that all its sensors are armed to detect the arrival of a bagged product.

Once the machine is in tying operation, the illumination of the FAULT LIGHT 88 indicates a condition that will prevent successful completion of the current cycle, or of the next cycle. When a fault occurs, the start/reset button 86 must be depressed to turn off the fault light 88 (after the physical problem has been cured) and return the apparatus 40 to its "ready state".

The function of the JOG BUTTON 90 is to put the apparatus 40 through either one complete cycle, or a half-cycle. A complete cycle (maintain contact) is necessary to initially "thread" the tying ribbon into the machine. Jogging the machine ½ cycle (momentary contact) may be necessary in clearing a hook fault, or certain other faults.

The fault light 88 illuminates upon occurrence of any of several conditions, detected by sensors, that indicate inability to successfully complete the current tying cycle, or the next one. The various possible faults include:

Tie Drop

Hook Jam

Pusher Pad Positioning Error

Needle Up Too Long

Naked Loaf

The fault light 88 is extinguished and the apparatus 40 is returned to its "ready state" by physically correcting the error condition, and depressing the start/reset button 86.

The EMERGENCY STOP BUTTON 92 is simply depressed to stop the apparatus 40 and turn off power to its operating components. All functions of the apparatus 40 stop instantly. The operator must twist clockwise the emergency stop button 92 (which then 'pops out') and depress the start/reset button 86 to return the apparatus 40 to the "ready state".

The COUNTER 94, which may be reset to zero by depressing the red button on the side of the counter face panel, counts the number of completed tying cycles. It operates independently of the bagging machine.

ADJUSTMENT PROCEDURES

The following adjustment procedures may be used at the time of initial installation of the apparatus 40:

A. Speed

Figure 5:
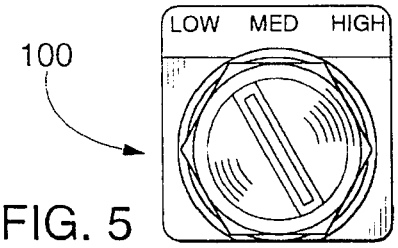
FIG. 5 is an illustration of the speed control selector of the apparatus of the present invention.

Referring to FIG. 5, tying speed may be adjusted by a three-position INDICATOR KNOB 100 inside the control box 82. Speed adjustments should be made only by authorized equipment engineers, who will determine the correct speed selection for each potential production line application of the apparatus 40.

Any one of the three speed categories, to match the speed of the bagging machine conveyor, may be selected; HIGH, MEDIUM, or LOW. The range of each category is preset, based upon specifications selected when the apparatus 40 is constructed. Typical speed ranges are:

| SETTING | BAGGER CONVEYOR SPEED |
|---|---|
| High | 105–85 feet per minute |
| Medium | 85–60 feet per minute |
| Low | 60–45 feet per minute |

The speed ranges need not be contiguous. The apparatus 40 infeed belts of the apparatus 40 must run from about 130% to 250% faster than the associated bagger conveyor.

B. Tightness of Bag Around Product

Figure 6A:
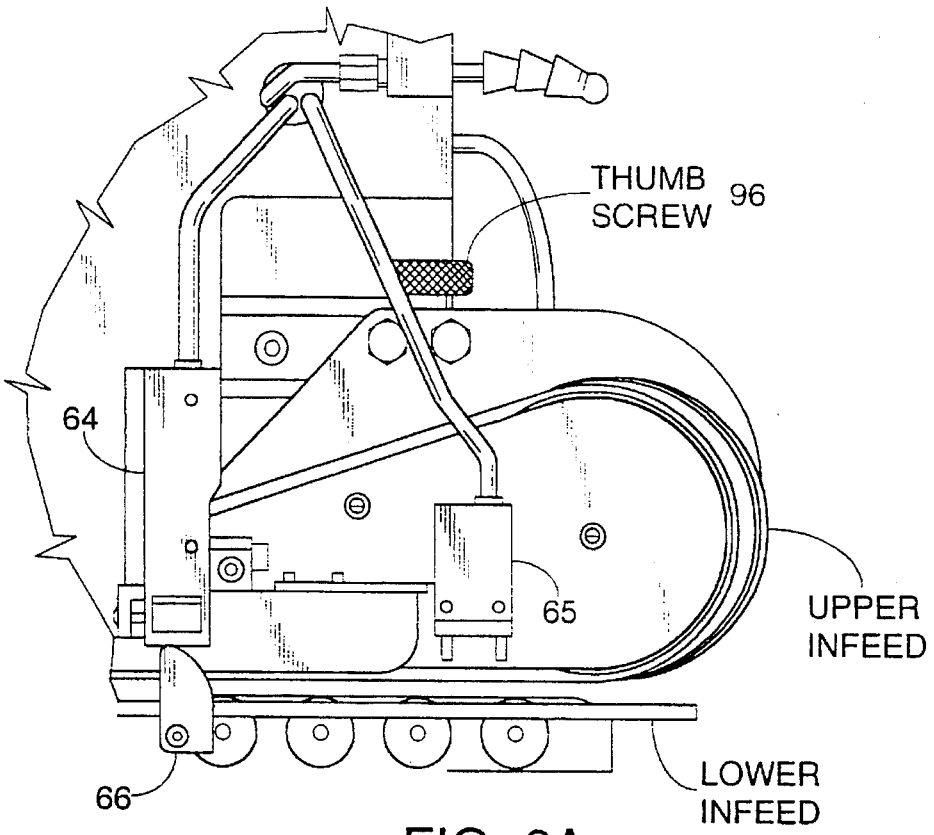
FIG. 6A is a front view illustrating the infeed components of the apparatus of the present invention.
Figure 6B:
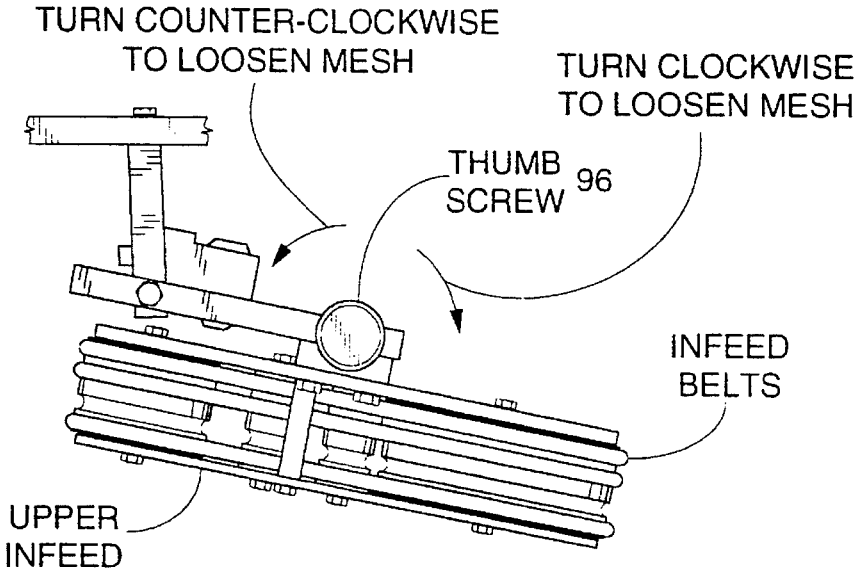
FIG. 6B is a top view of the apparatus shown in FIG. 6A.

As is shown in FIG. 6, the bag will be pulled more tightly around the product when the upper and lower infeed belts are more deeply meshed; the bag will be less tightly pulled around the product with a less deep mesh. Depth of belt mesh may be adjusted with the THUMB SCREW 96.

C. Tightness of Twist Tie

The tightness of the twist tie may be adjusted by altering the air pressure controlled by the SPOOL/BRAKE PRESSURE REGULATOR 98. Tight ties will be made with air pressure of about 50 psi, while loose ties will be formed with pressure set about 30 psi. To assure proper operation of the apparatus 40, pressure settings lower than 25 psi should not be used.

D. Positioning Tie in Center of Bag

Figure 7:
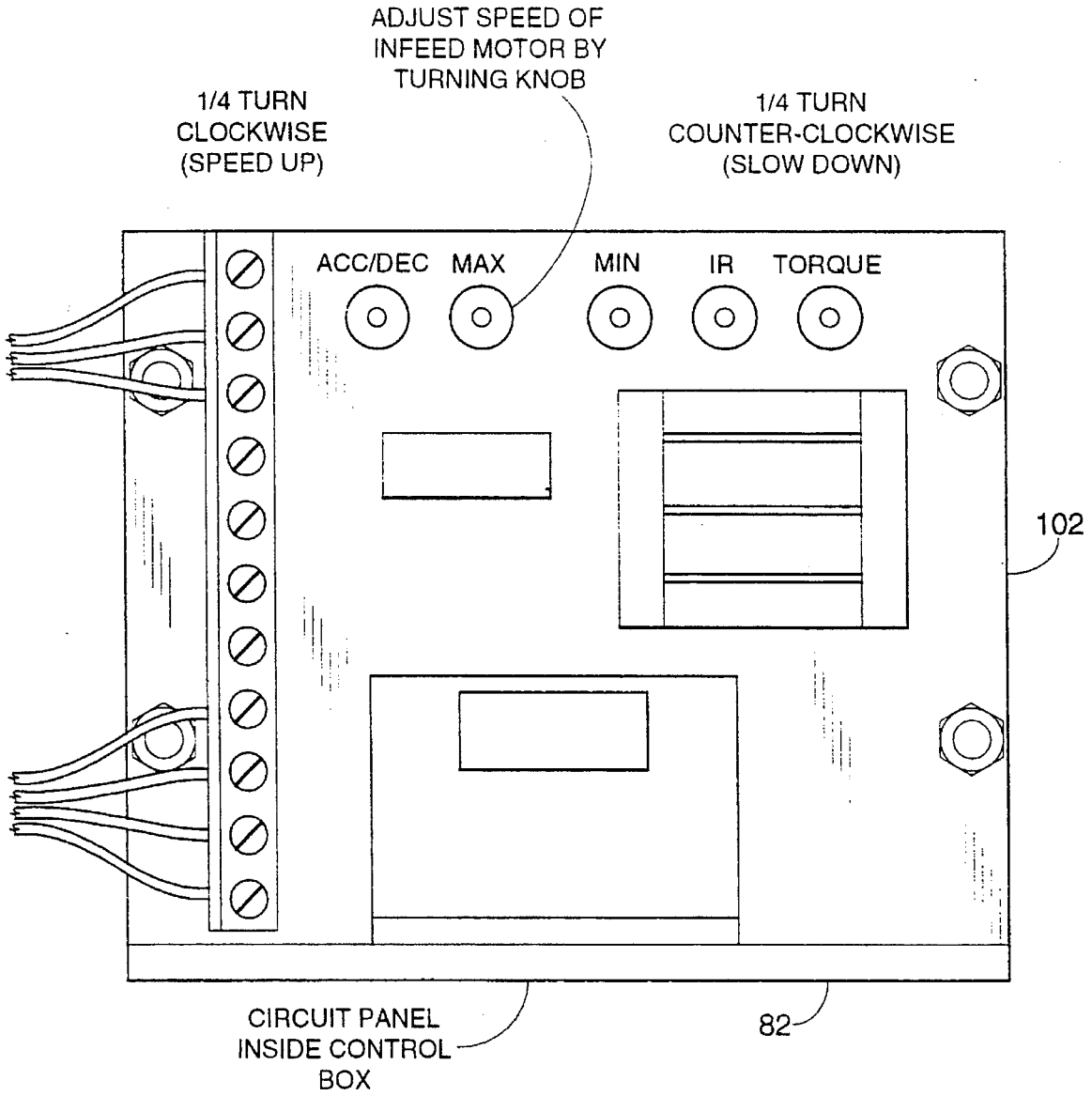
FIG. 7 is an illustration of the circuit panel of the apparatus of the present invention.
Figure 8A:
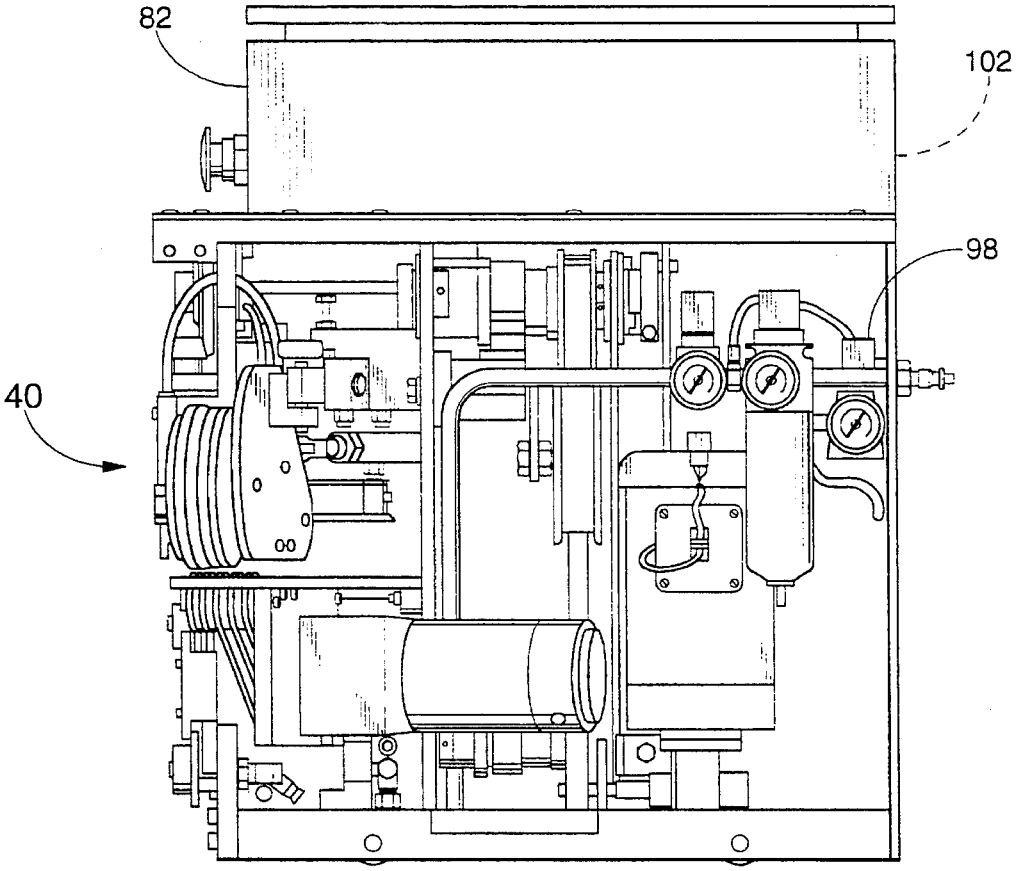
FIG. 8A is a side view further illustrating the pressure regulation components of the apparatus of the present invention.
Figure 8B:
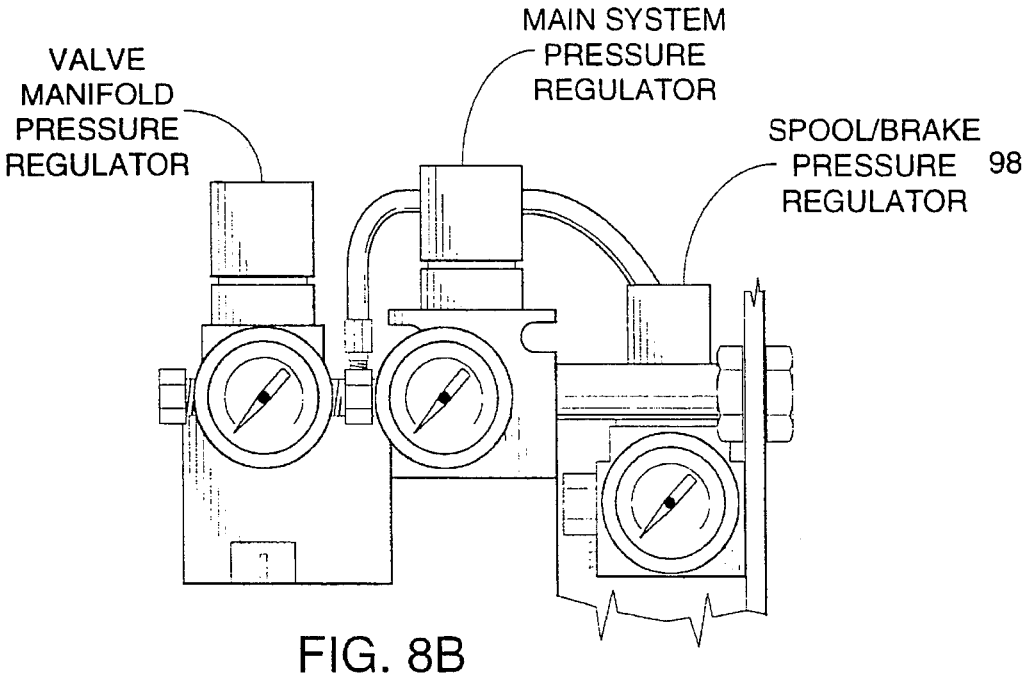
FIG. 8B is a top view of the apparatus shown in FIG. 8A.

The speed of the infeed belts must be set properly relative to the speed of the bagger conveyor. Turn the appropriate knob (depending on speed selector setting shown in FIG. 7) clockwise ¼ turn to Speed up the infeed belts if the tie is too far to the 'leading edge' of the bag. Turn it counterclockwise ¼ turn to slow down the infeed belts if the tie is too far to the 'trailing edge'. Test tie a loaf or two to investigate ribbon positioning. Repeat step as required.

E. Eliminating Bag Damage

Referring to FIG. 14, damage to bags of 1.0 mil or thinner, may occur at an unacceptable rate if air pressure on the spool brake and the bag clamp 70 is too high. The combined effect is to create too much ribbon tension on the bag neck stretched too tightly from the bag clamp 70. Reduce the air pressure on each by 5 psi and investigate tied bags. Repeat if necessary.

Figure 19D:
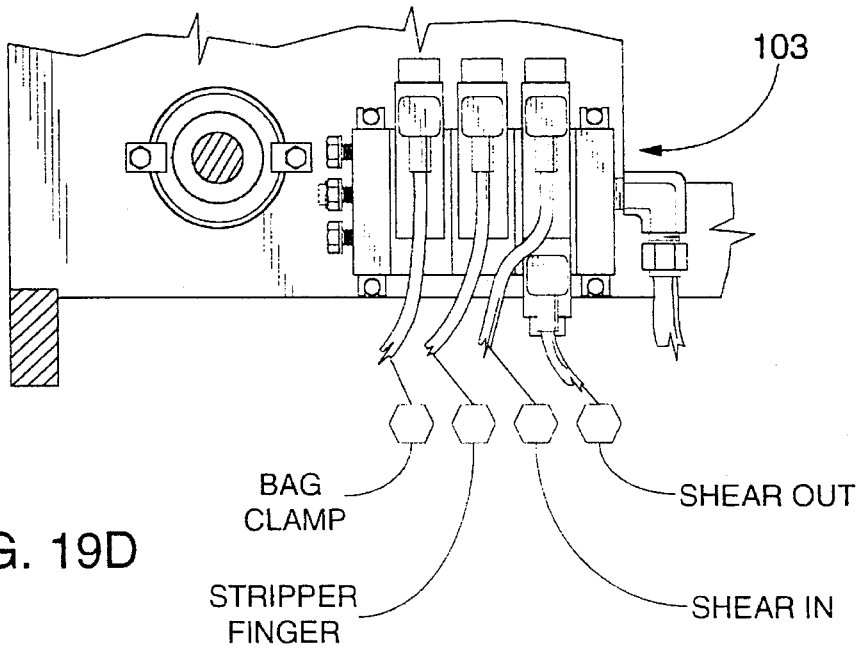
FIG. 19D is an illustration of the pneumatic logic block of the apparatus of the present invention.
Figure 20A:
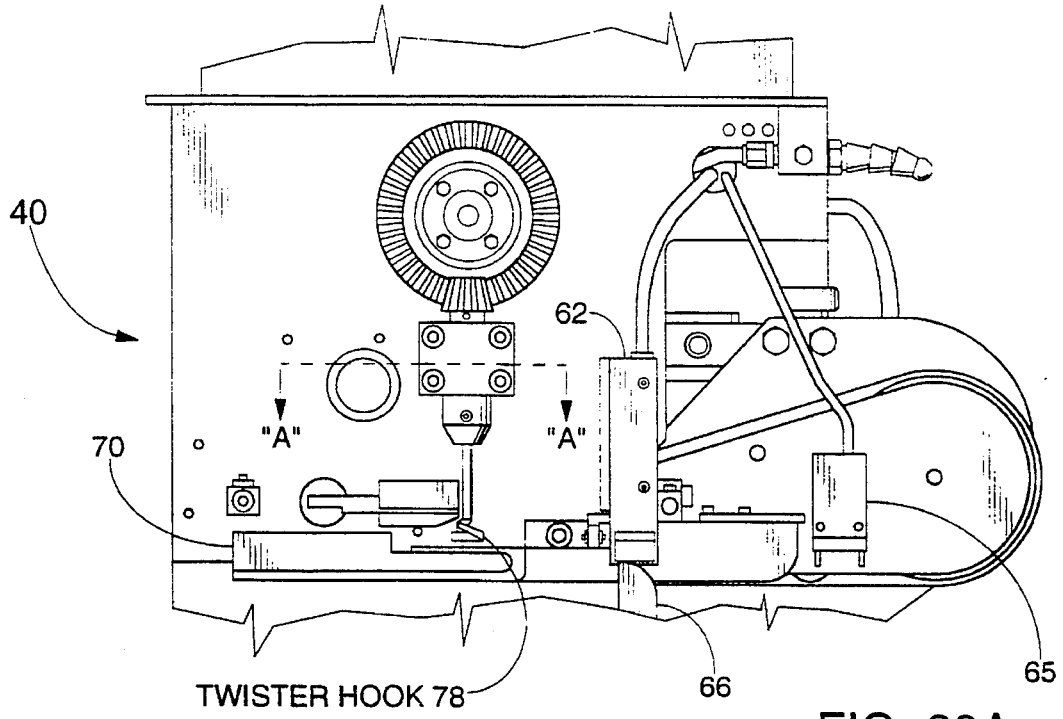
FIG. 20A is an illustration of certain component parts of the apparatus of the present invention illustrating the operation of the twister hook thereof.
Figure 20B:
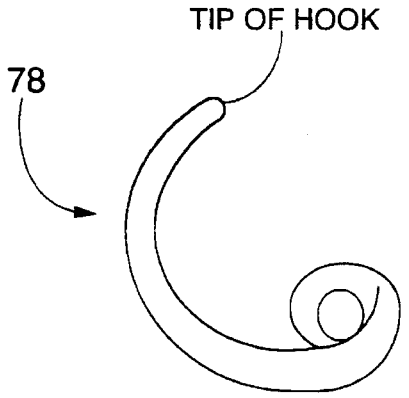
FIG. 20B is a view taken along the lines A—A of FIG. 20A.
Figure 21:
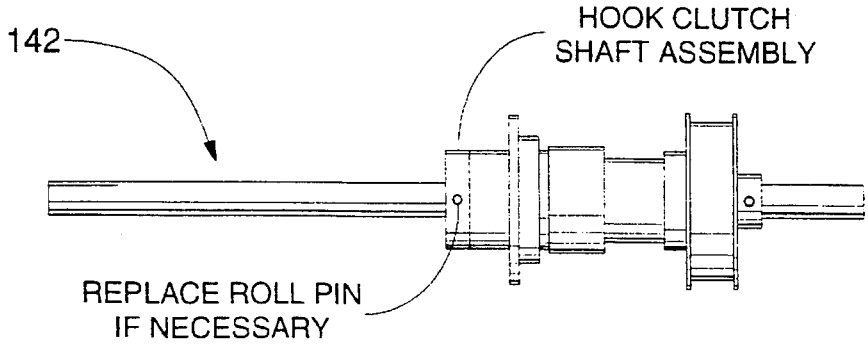
FIG. 21 is an enlargement of an illustration of the drive mechanism of the apparatus of the present invention.
Figure 22:
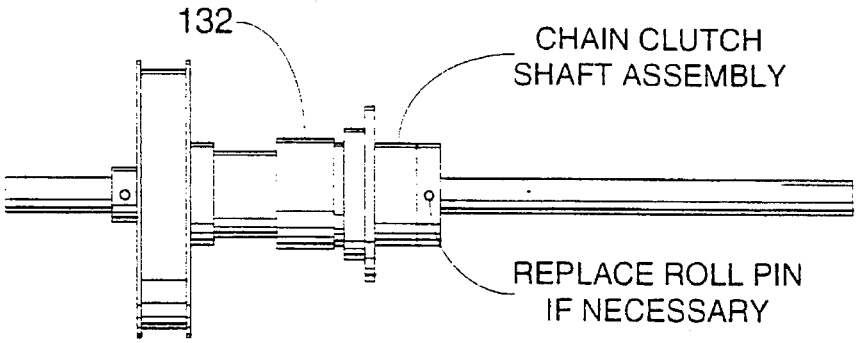
FIG. 22 is a further enlargement of the drive mechanism of the apparatus of the present invention.
Figure 23:
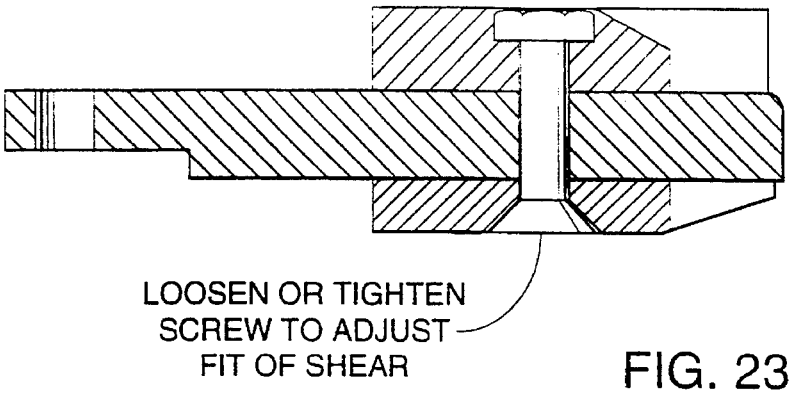
FIG. 23 is an enlargement of an illustration of the shearing mechanism of the apparatus of the present invention.
Figure 24:
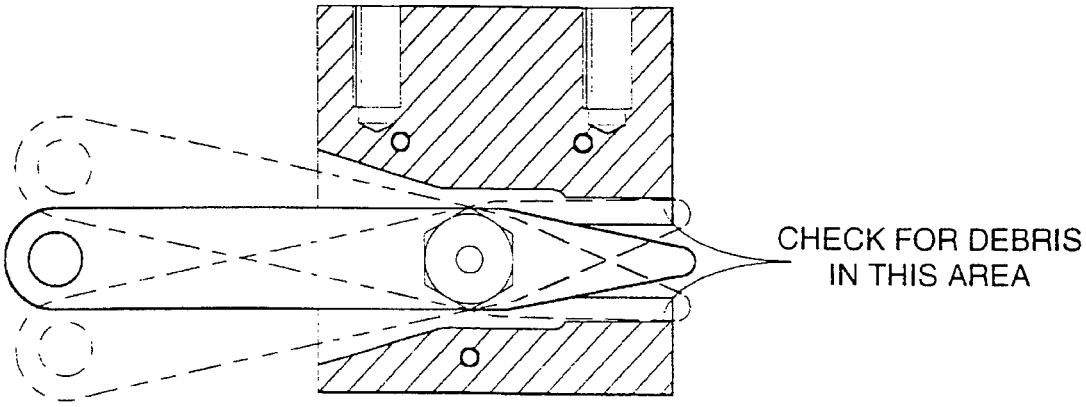
FIG. 24 is a further illustration of the shearing mechanism of the apparatus of the present invention.

As is best shown in FIG. 19D, the apparatus 40 includes a PNEUMATIC LOGIC BLOCK 103 which functions under control of the PLC 102 to control the operation of the bag clamp to secure the bag in place during tying operations; to control the operation of the stripper finger to clear the twist tie out of engagement with the twister hook after the tie has been completed; and to control the operation of the shear to sever the leading end of the ribbon from the ribbon supply, thereby forming the twist tie.

Figure 9:
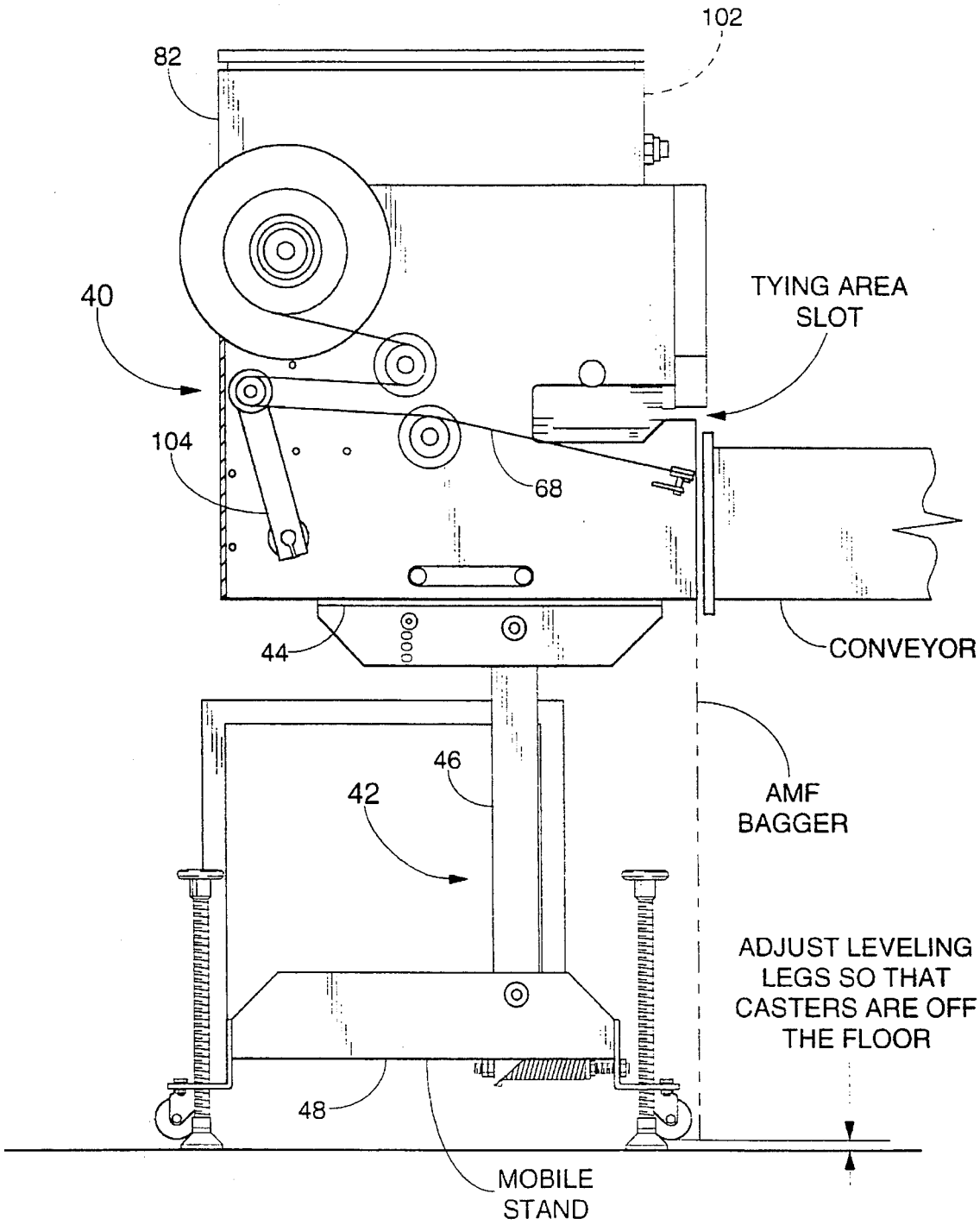
FIG. 9 is a view showing the apparatus of the present invention installed and ready for operation.
Figure 10:
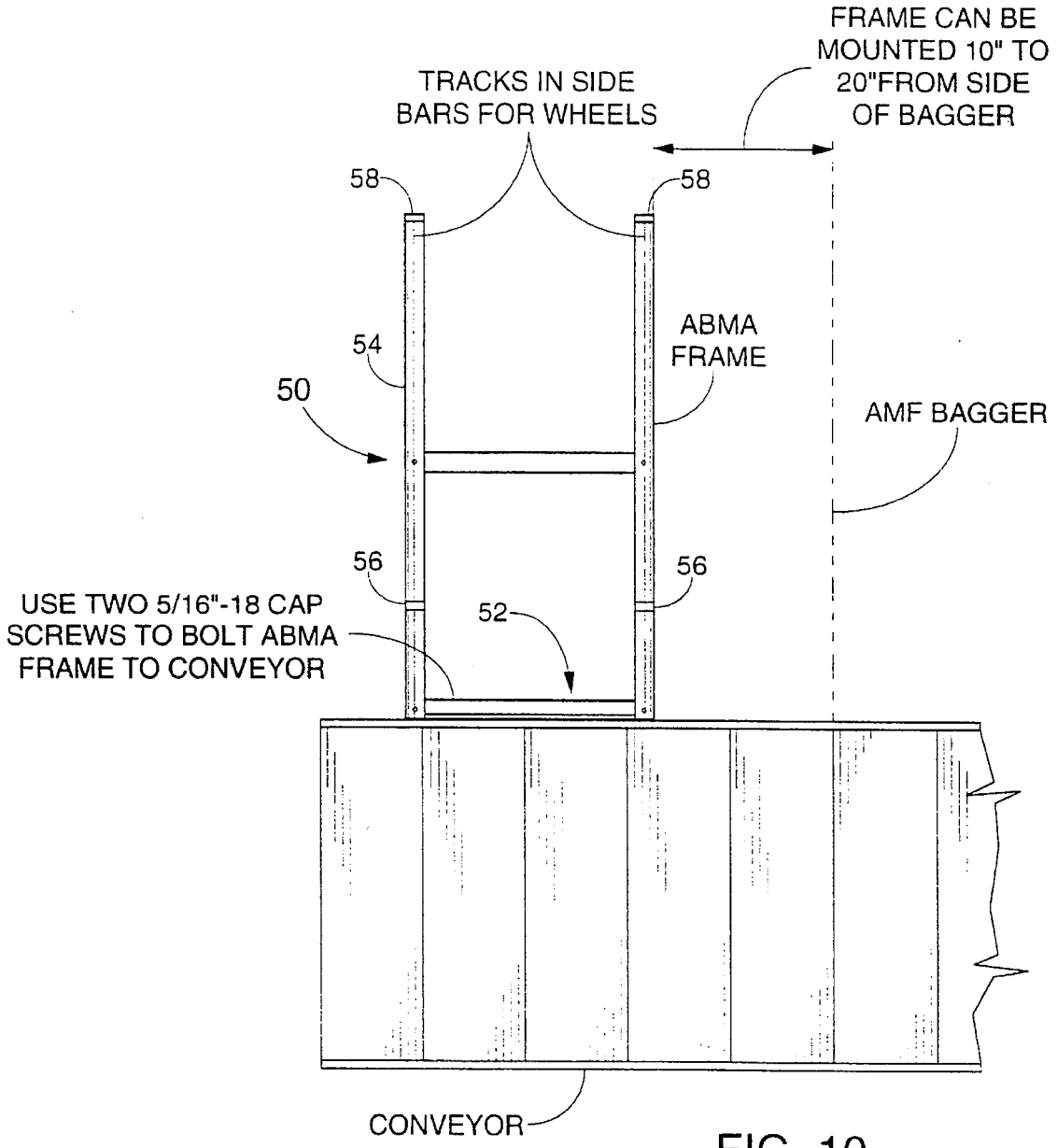
FIG. 10 is a top view further illustrating the installation of the apparatus of the present invention.
Figure 11A:
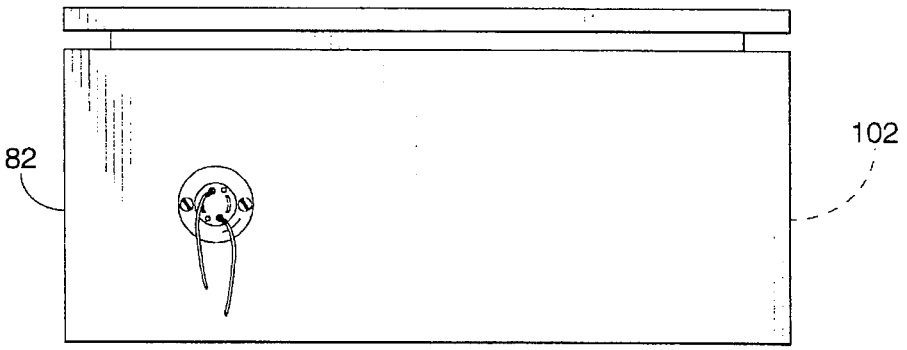
FIG. 11A is a rear view of the control box of the apparatus of the present invention.
Figure 11B:
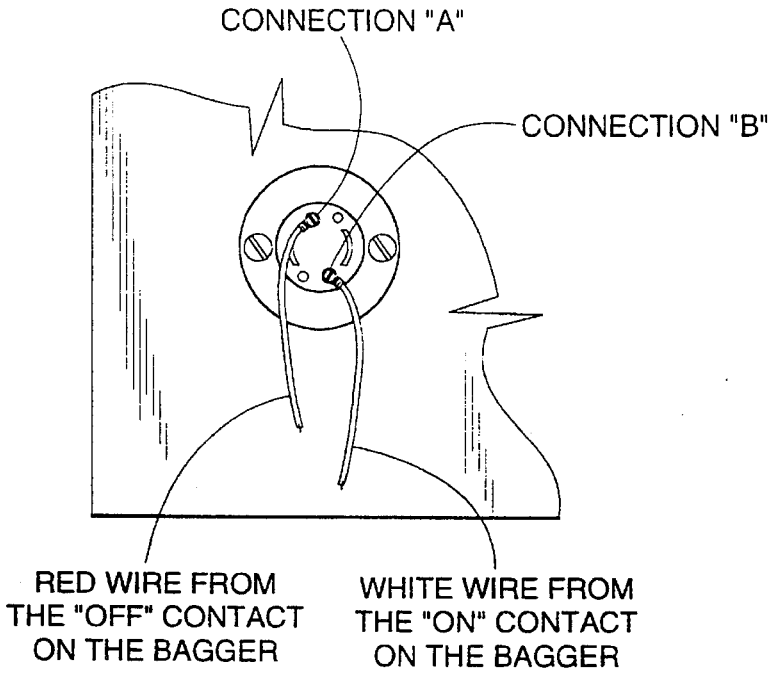
FIG. 11B is an enlargement of the portion of FIG. 11A.
Figure 26A:
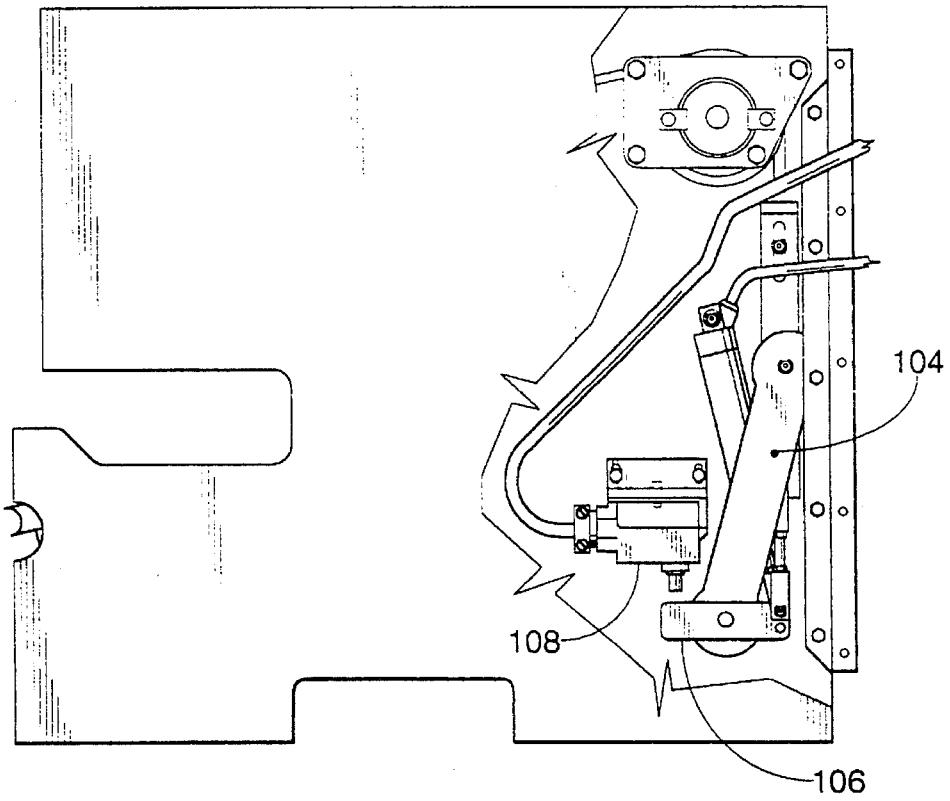
FIG. 26A is an illustration of the spool/brake plate assembly of the apparatus of the present invention.
Figure 26B:
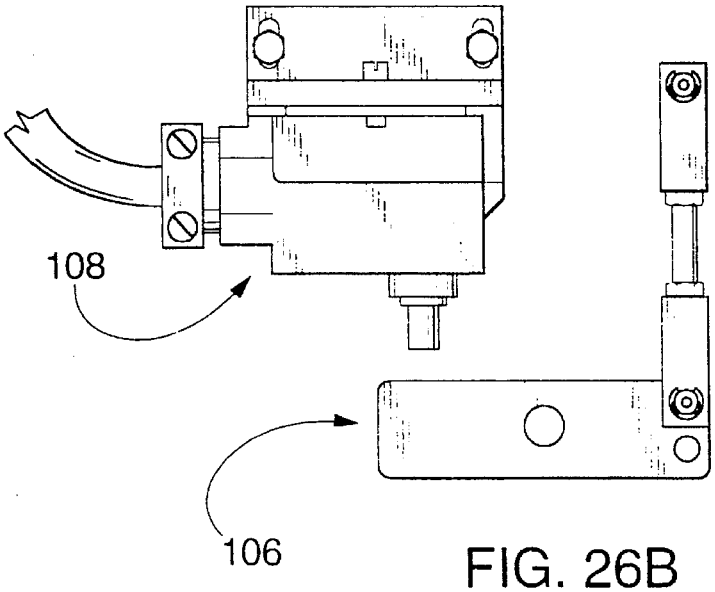
FIG. 26B is an enlargement of a portion of FIG. 26A.
Figure 27A:
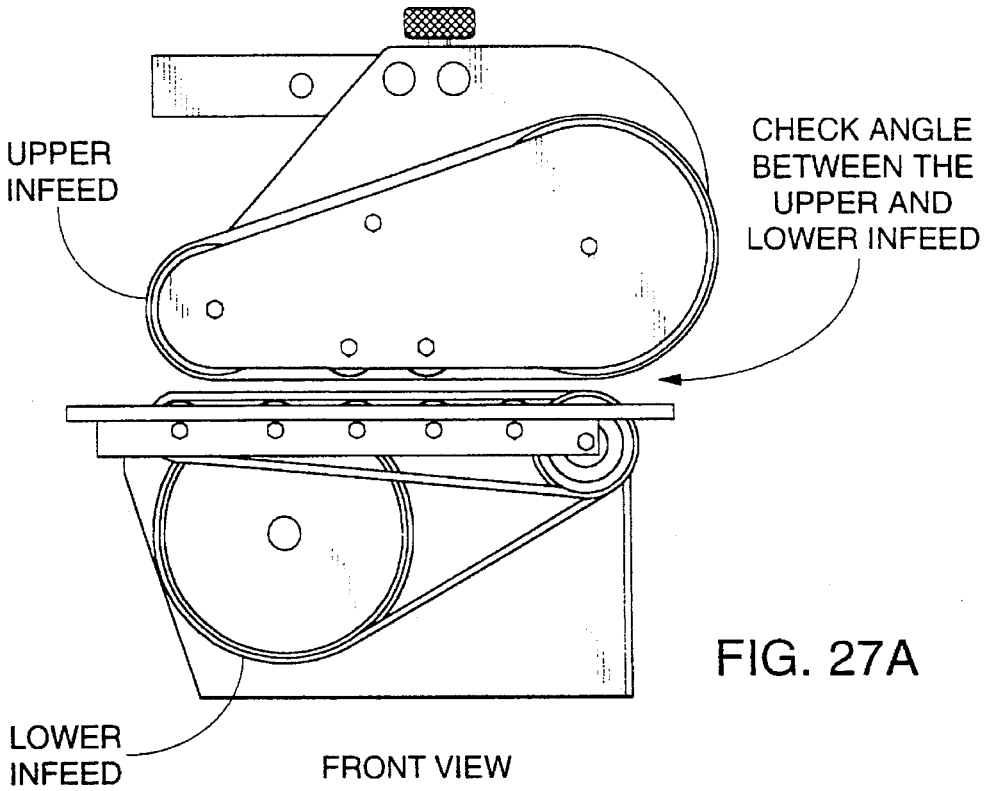
FIG. 27A is a front view illustrating the infeed components of the apparatus of the present invention.
Figure 27B:
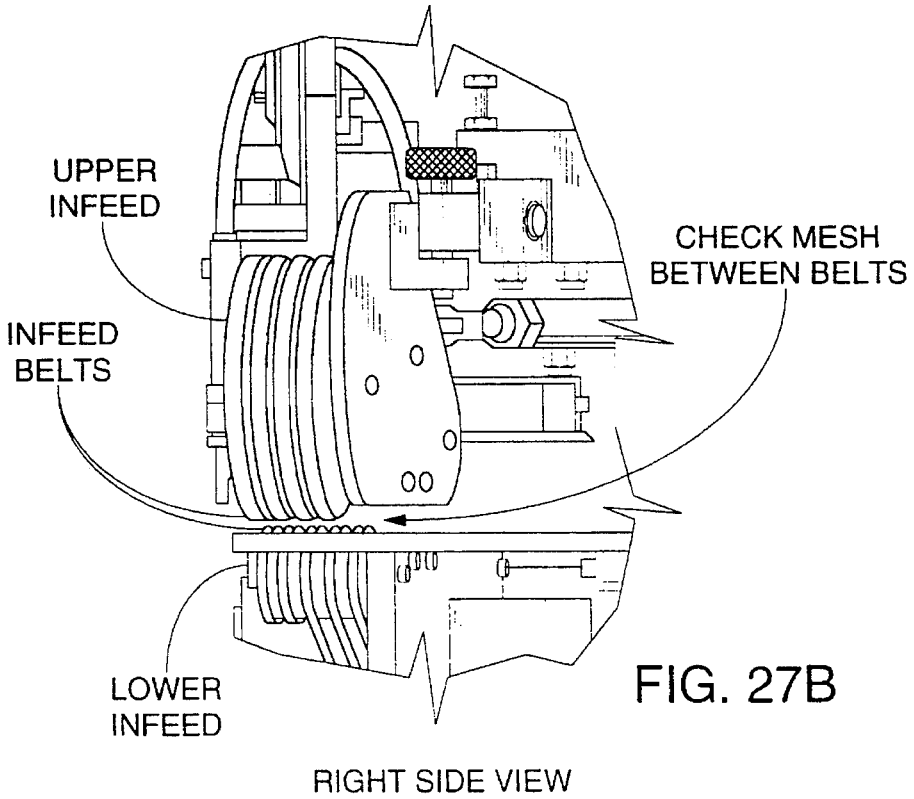
FIG. 27B is a right side view further illustrating the infeed components of the apparatus of the present invention.

Referring to FIG. 9, the ribbon 68 passes over a dancer arm 104. As is best shown in FIG. 26, the dancer arm 104 operates a lever 106 which in turn actuates a microswitch 108. Microswitch 108 is in turn connected to the PLC 102. Therefore, upon actuation of the needle, if the ribbon 68 is not caught, the dancer arm 104 actuates the microswitch 108, whereupon the PLC terminates operation of the apparatus 40 and the associated conveyors and product bagging apparatus.

Figure 25:
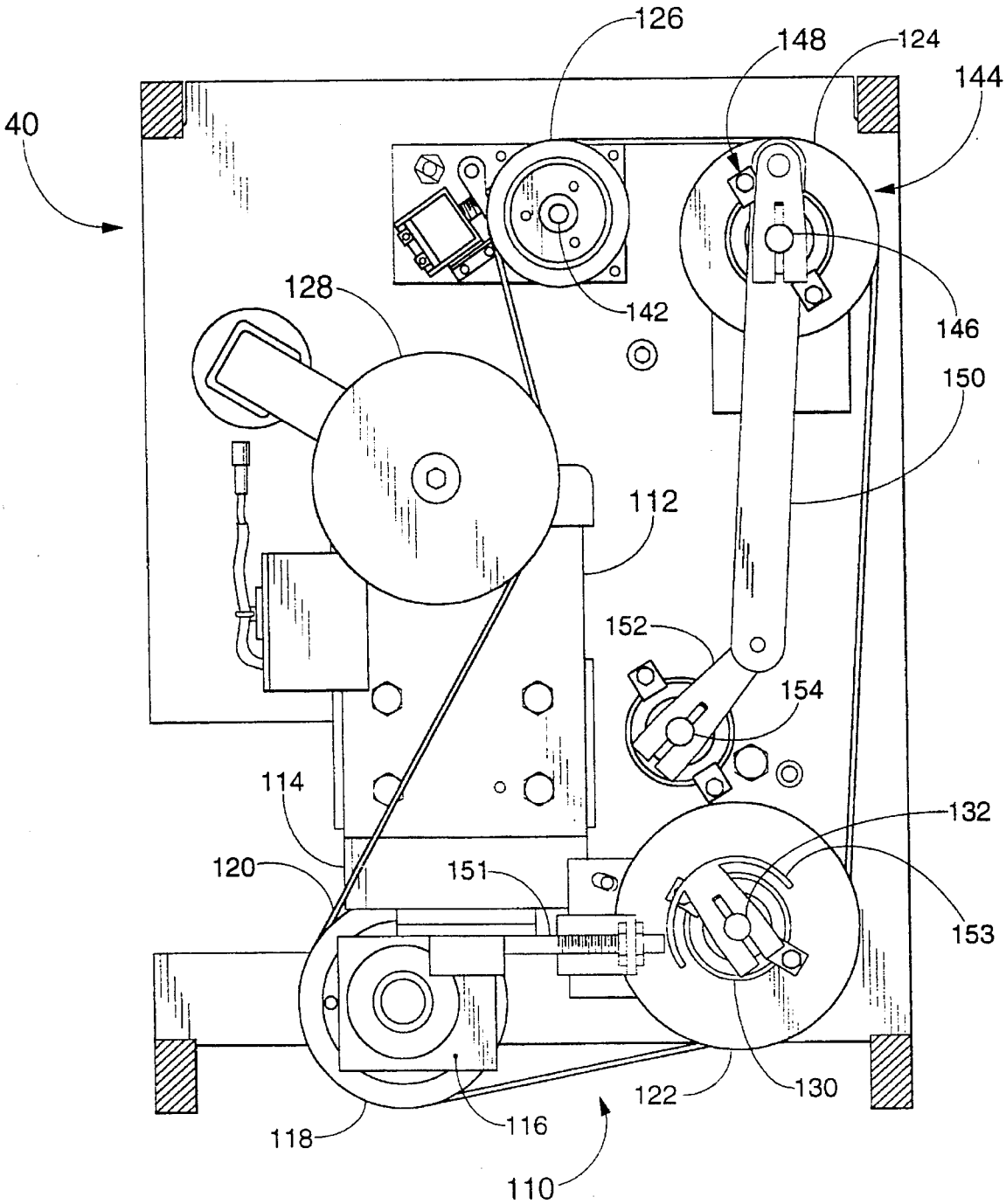
FIG. 25 is an illustration of the drive belt portion of the apparatus of the present invention.

Referring now to FIG. 25, the apparatus 40 includes a DRIVE MECHANISM 110. A MOTOR 112 operates through a SPEED REDUCER 114 and a RIGHT ANGLE DRIVE 116 to drive a DRIVE PULLEY 118. The drive pulley 118 in turn drives a DRIVE BELT 120. The drive belt 120 in turn drives three DRIVEN PULLEYS 122, 124, and 126. The driven pulley 122 is associated with and is utilized to control operation of the pusher pad assembly; the driven pulley 124 is associated with and is utilized to effect operation of the needle assembly; and the driven pulley 126 is associated with and is utilized to effect operation of the twister hook assembly. An IDLER PULLEY 128 is utilized to maintain appropriate tension in the drive belt 120.

Figure 34:
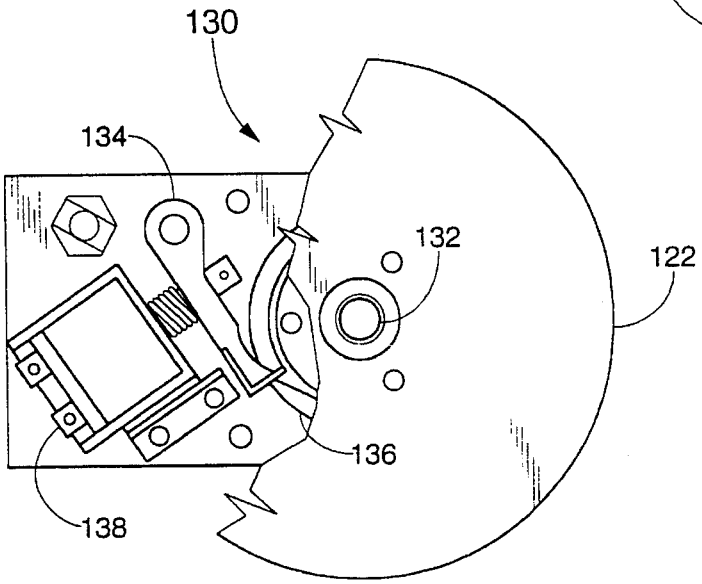
FIG. 34 is an illustration of one of the partial revolution clutches utilized in the apparatus of the present invention.

Referring simultaneously to FIGS. 25 and 34, a PARTIAL REVOLUTION CLUTCH 130 is associated with and is utilized to transfer motion from the driven pulley 122 to the pusher pad assembly DRIVE SHAFT 132. The single revolution clutch includes a HOOK 134 which normally engages a detent formed in a RING 136 to prevent rotation of the drive shaft 132. Upon actuation by the PLC 102, a SOLENOID 138 raises the hook 134 to allow rotation of the ring 136 and hence the drive shaft 132. Actuation of the solenoid 138 to raise the hook 134 is momentary. Immediately following actuation by the solenoid 138, the hook 134 reengages the ring 136 and therefore falls into the next detent formed therein to arrest rotation of the ring 136 and therefore the drive shaft 132.

Figure 32:
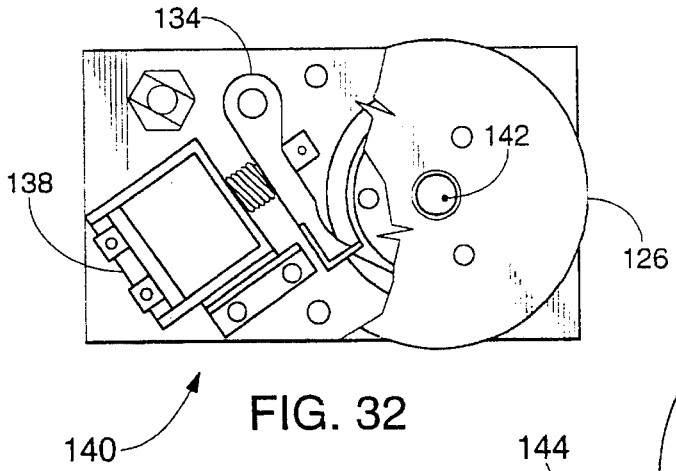
FIG. 32 is an illustration of one of the partial revolution clutches utilized in the apparatus of the present invention.
Figure 33:
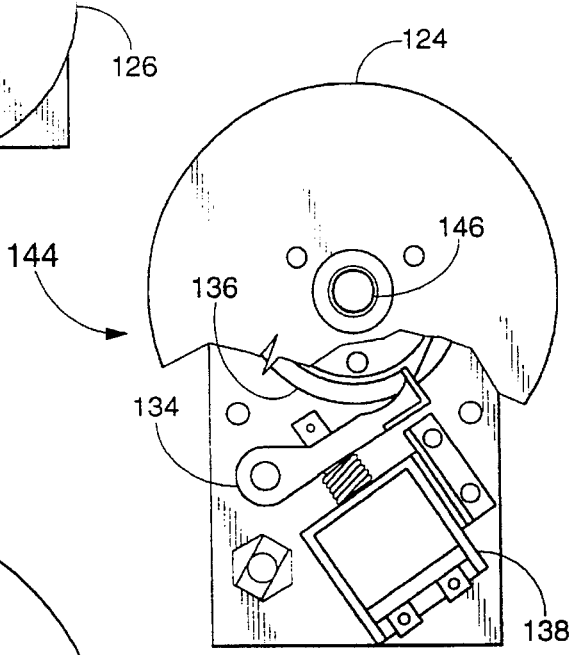
FIG. 33 is an illustration of one of the partial revolution clutches utilized in the apparatus of the present invention.

Referring to FIGS. 32 and 33, a PARTIAL REVOLUTION CLUTCH 140 is utilized to transfer motion from the driven pulley 126 to the DRIVE SHAFT 142 of the twist hook assembly. A PARTIAL REVOLUTION CLUTCH 144 is utilized to transfer motion from the driven pulley 124 to the DRIVE SHAFT 146 of the needle assembly. The partial revolution clutches 140 and 144 are identical in construction and operation to the partial revolution clutch 130 shown in FIG. 34 and described hereinabove in connection therewith. Hence, the component parts of the revolution clutches 140 and 144 are designated in FIGS. 32 and 33 with the same reference numerals utilized in the description of the partial revolution clutch 130.

Referring again to FIG. 25, upon actuation of the partial revolution clutch 144, the drive shaft 146 is rotated under the action of the drive belt 120 and the driven pulley 124. The drive shaft 142 operates a CRANK 148 which is pivotally connected to an ARM 150. The arm 150 is in turn pivotally connected to an ARM 152 which is fixed to a NEEDLE SHAFT 154. Therefore, upon actuation of the partial revolution clutch 144, the needle 72 is rocked first upwardly, and then downwardly to effect operation of the apparatus 40.

Still referring to FIG. 25, a PROXIMITY SWITCH 151 senses the presence of a RING 153 and thereby determines actuation of the drive shaft 132 to move the pusher pads along the path of travel of bags through the apparatus 40. Failure of the proximity switch 151 to ascertain pusher pad movement causes the PLC 102 to terminate operation of the apparatus 40.

Referring now to FIG. 28, the drive shaft 142 drives a BEVEL GEAR 168 which in turn drives a BEVEL PINION 170. The bevel pinion 170 drives a DRIVE SHAFT 172 which drives the twister hook 78.

The drive shaft 132 drives a SPROCKET 174 which drives a CHAIN 176. The chain 176 extends around a course defined by the sprocket 174 and three IDLER SPROCKETS 178. The chain 176 carries the pusher pads 66.

Figure 35:
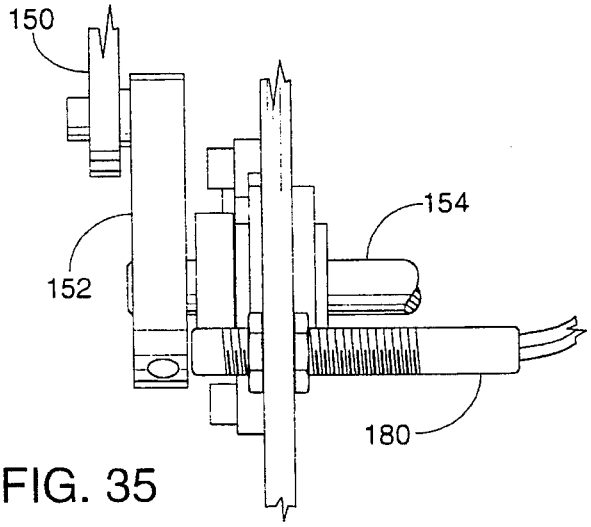
FIG. 35 is a further illustration of part of the structure shown in FIG. 25.

FIG. 35 illustrates a PROXIMITY SWITCH 180 which senses the presence of arm 152 which is connected between arm 150 and needle shaft 154. In this manner, the condition of proximity switch 180 is determinative of the location of the needle 72, that is, whether or not the needle 72 is in the up condition.

Figure 36A:
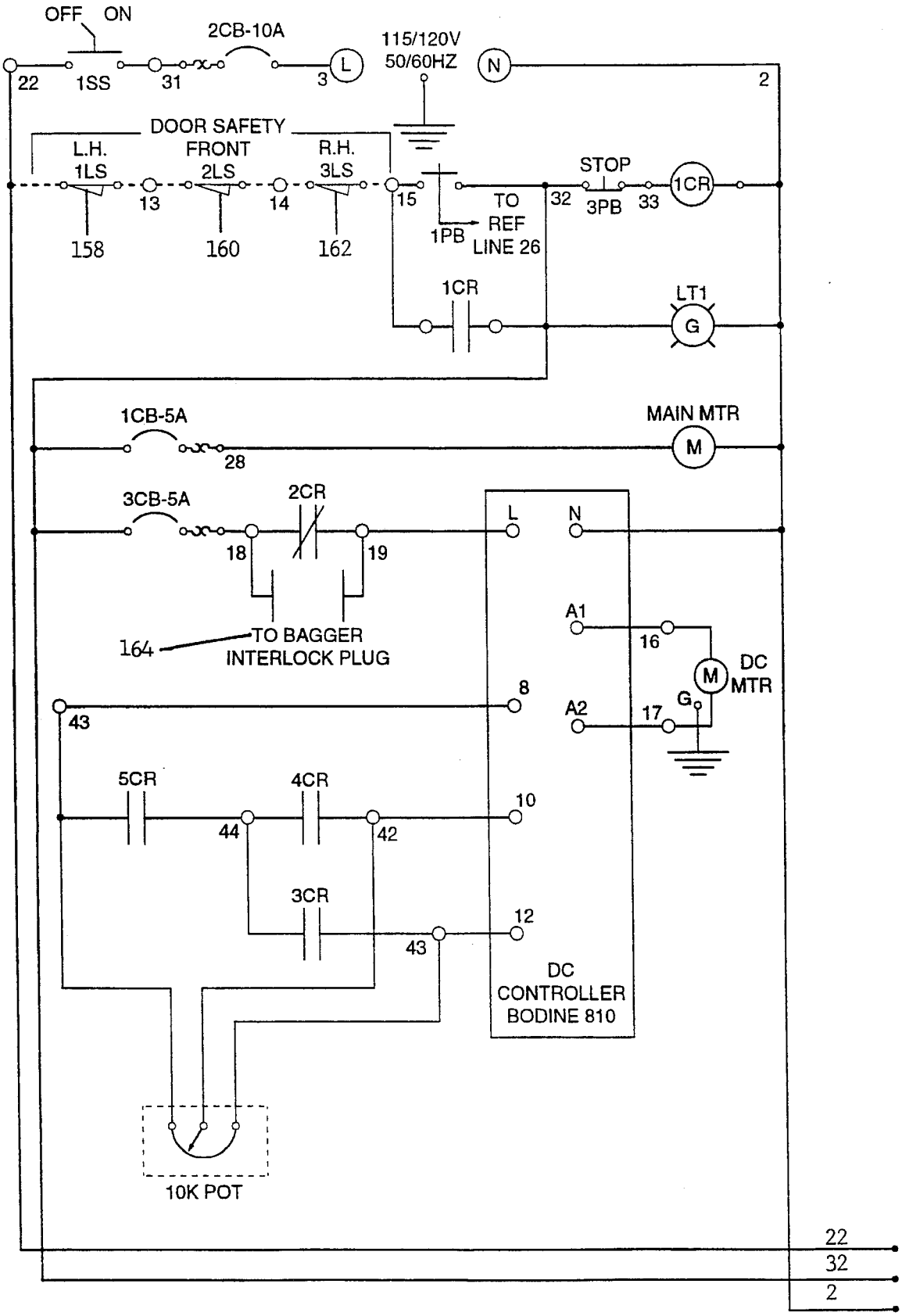
FIG. 36A is a schematic illustration of the electrical circuitry of the apparatus of the present invention.
Figure 36B:
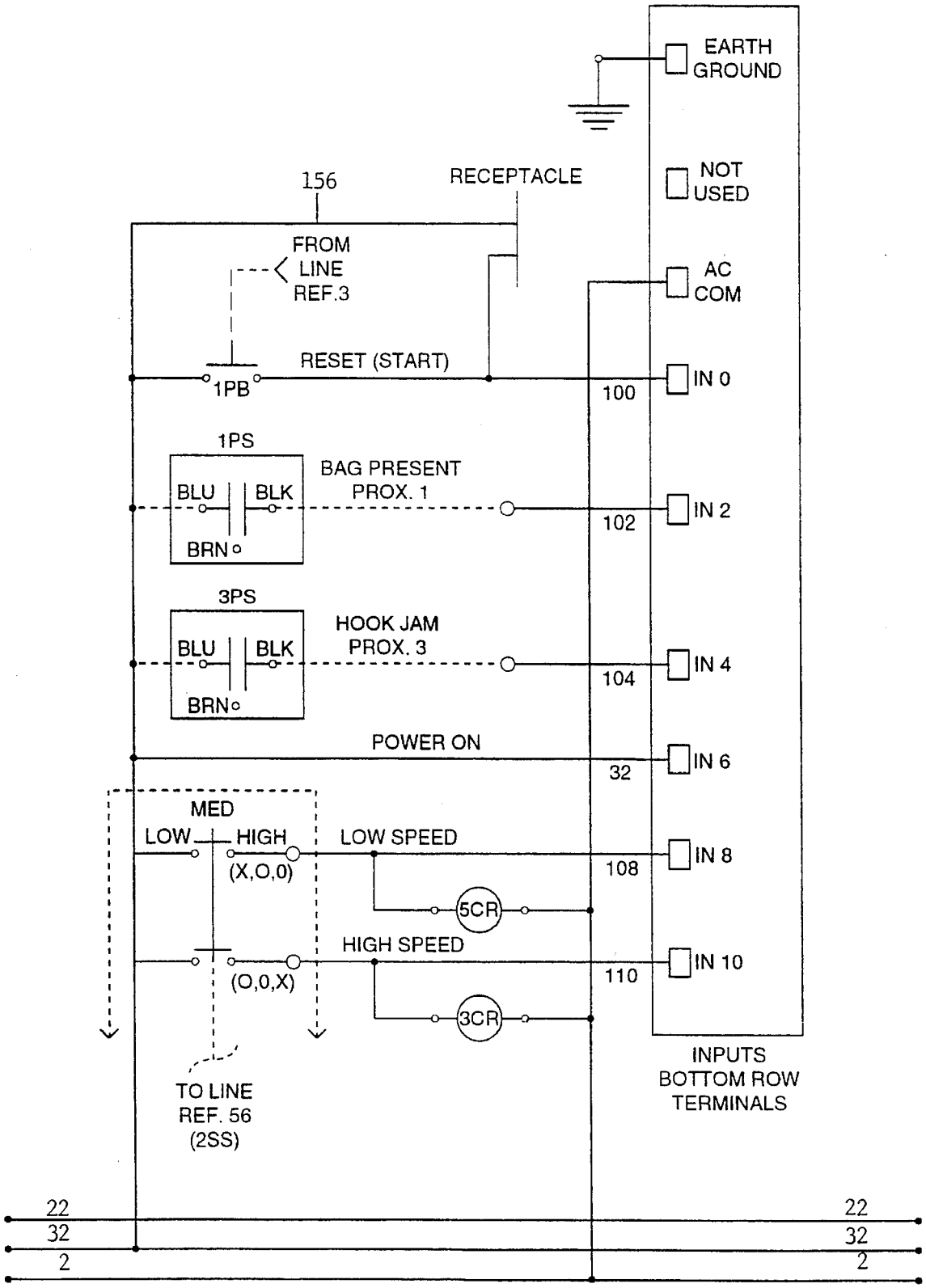
FIG. 36B is a continuation of FIG. 36A, which illustrates the electrical circuitry of the apparatus of the present invention.
Figure 36C:
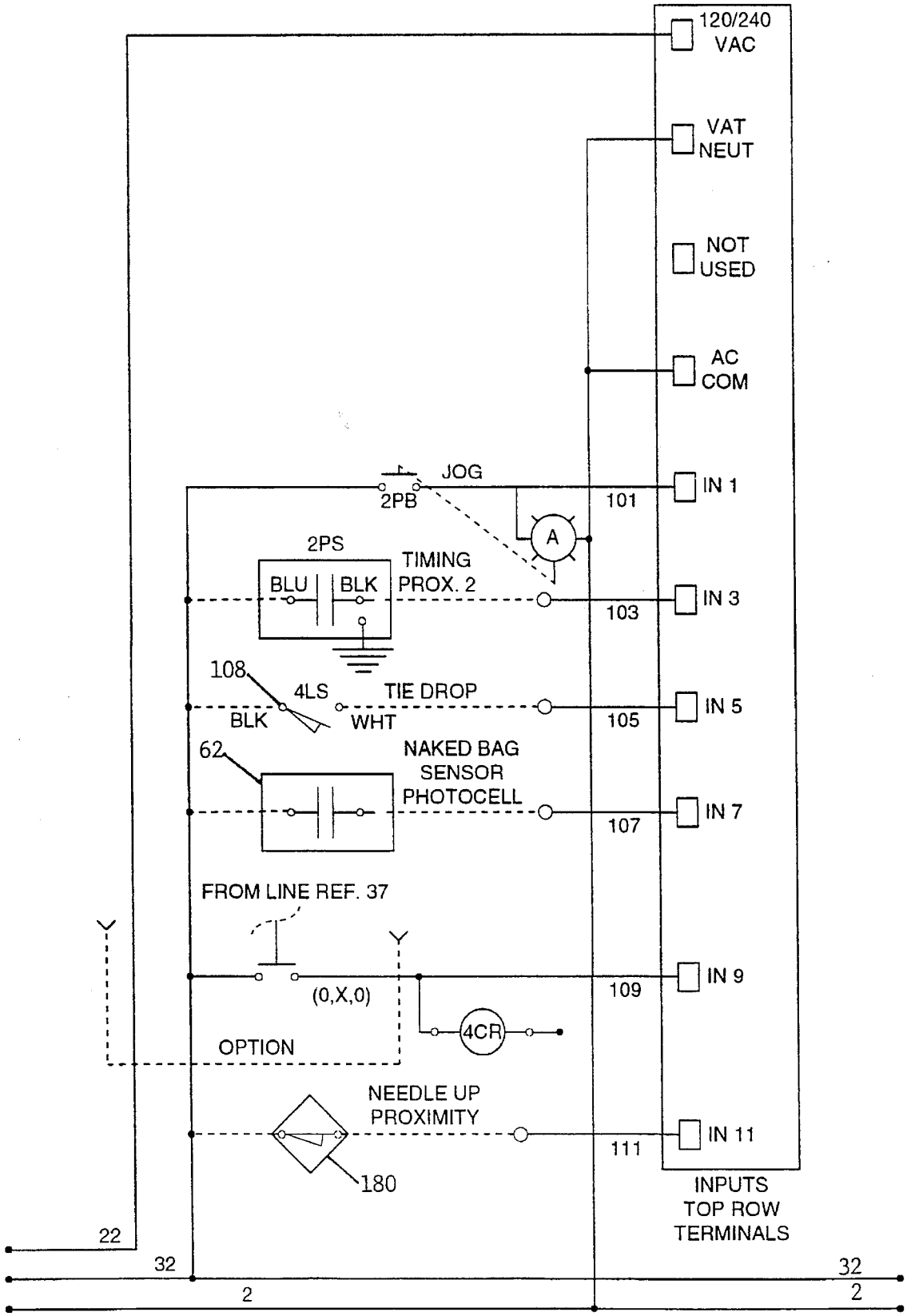
FIG. 36C is a continuation of FIG. 36B, which illustrates of the electrical circuitry of the apparatus of the present invention.
Figure 36D:
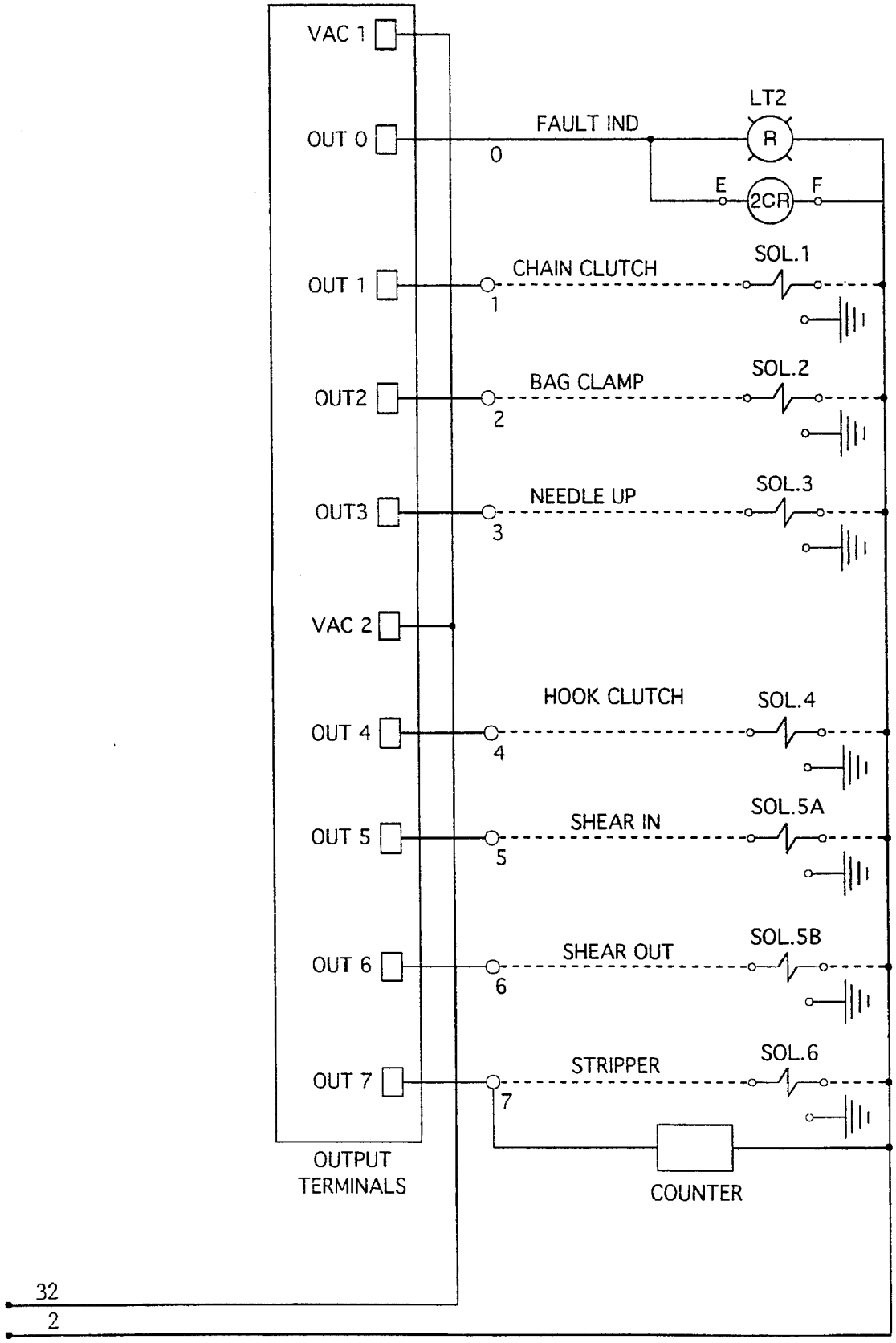
FIG. 36D is a continuation of FIG. 36C, which illustrates of the electrical circuitry of the apparatus of the present invention.

Referring now to FIGS. 36A, B, C and D, the various electrical components of the apparatus 40, and the interconnections thereof are illustrated and described. The ELECTRICAL CIRCUIT 156 includes DOOR SAFETY SWITCHES 158, 160, and 162 which prevent operation of the apparatus 40 if the doors of the housing thereof are not in place and closed. A BAGGER INTERLOCK PLUG 164 is utilized to place the bagging machine and the associated conveyors which feed bagged product to the apparatus 40 under control of the PLC 102. In this manner, any malfunction within the apparatus 40 immediately stops operation of the bagger and the associated conveyors, thereby preventing the wasting of product as has been experienced in the use of prior art apparatus.

The circuit 156 further includes various sensors which are utilized to determine fault conditions under which the operation of the apparatus 40 is terminated. The microswitch is actuated in the event the ribbon 68 is not caught. The naked loaf detector 62 is actuated upon the presence of unwrapped product entering the apparatus 40. The needle up proximity switch 180 is utilized to sense the needle 72 in the up position. The circuit 156 further comprises outputs which are utilized to effect actuation of the various components of the apparatus 40.

OPERATION

Control Buttons and Switches

Power Switch 80

A two-position switch on the left front of the control box 82 (FIG. 4) is used to control power availability to the apparatus 40. Turning the power switch 80 to the "ON" position provides power to the PROGRAMMABLE LOGIC CONTROL (PLC) 102, but no physical movement of any component of the apparatus 40.

However, turning the power switch 80 to the "OFF" position immediately removes power, not only from the PLC 102, but from every moving component. After completion of any motion that has already begun, all motion stops. Only the computer PLC 102 memory is still active.

When the power switch 80 is turned to the "ON" position, the PLC 102 is "armed" and able to react to further commands in the start-up sequence.

Circuit Breaker 84

On the upper left of the front of the control box 82, above the ON/OFF switch 80, is a 5.0 amp pop-out circuit breaker 84 that protects the main drive motor from excessive overload. Certain fault conditions, such as a hook jam, may result in a voltage surge sufficient to damage the motor. Generally, such a voltage surge will result from an event that would cause a fault light 88 illumination, thereby stopping the machine. But in the rare instance where a fault light 88 is not activated in time, the circuit breaker 84 will instantly remove power to the main drive motor.

Start/Reset Button 86

This green button, a momentary contact push button, activates PLC 102 to check the position of all controlled components. If no problem is found, e.g., the ribbon 68 is threaded, the hook 78 and pusher pads 66 are in the correct positions, etc., the start/reset button 86 is illuminated with a green light, the infeed belts begin rotation, and all of the apparatus 40 sensors are "armed" to respond to the presence of a bag brought to the apparatus 40 by the bagger conveyor.

Jog Button 90

This amber push button, WHEN HELD IN, causes the apparatus 40 to complete one entire cycle. All components respond to timed signals from the PLC 102 to execute one full function in its turn. The operation of the jog button 90 is as if only one bag were to be fed into the infeed belts.

The jog button 90 is used in this way to initially thread ribbon 68 into the apparatus 40 in preparation for tying operations.

A fault could cause the apparatus 40 to stop with one or more of its components out of 'home' position. Depressing the jog button 90 MOMENTARILY will return all components to home position in order for the next cycle to begin, once the apparatus 40 is rethreaded.

The jog button 90 may also be useful in troubleshooting, since it allows you to see every function of the machine, unencumbered by a bagged product.

Fault Light 88

The red fault light 88 illuminates when an error condition is found during any tying cycle. A fault cancels the start/reset button 86, turning off the green light, and stopping power to the apparatus 40 (except the PLC 102). The occurrence of a fault is similar in all respects to depressing the emergency stop button 92.

The fault condition must first be physically corrected, and the start/reset button 86 must be depressed to enable the PLC 102 to arm all sensors again. If the fault condition is not successfully corrected (for example, plastic debris may remain on the twister hook 78 after a "hook jam fault" has supposedly been cleared), the fault light 88 will illuminate instantly and no power will be supplied to the apparatus 40.

Emergency Stop 92

The red E-Stop button 92 is a maintained push button. Its function is to immediately turn off power to all components, except the PLC 102 memory. The infeed belts instantly stop, but most functions that have begun will be completed, insofar as possible. The E-Stop button 92 must be twisted CLOCKWISE to end its effect.

PREPARATION TO TIE

Turn power switch 80 (left switch on the front of the apparatus 40) to ON.

Depress the green start/reset button 86. The apparatus 40 can than respond to other push button control commands.

Remove hub of spool (twist clockwise) holding spindle stationary.

Mount new ribbon 68 onto spindle so that ribbon will unwind from the back of the spool, toward the back of the apparatus 40.

Pull out about five feet of ribbon 68, and thread it around the ribbon guide pulleys.

Figure 12:
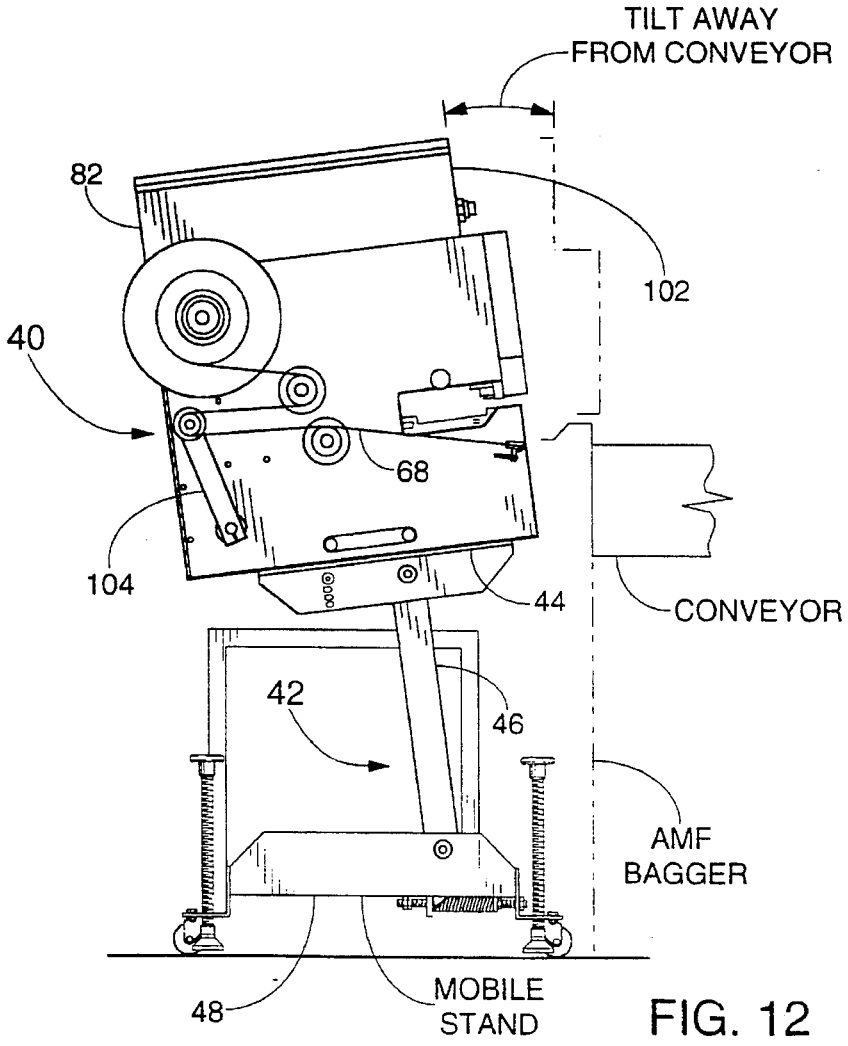
FIG. 12 is an illustration similar to FIG. 9 showing the apparatus of the present invention tilted away from the infeed conveyor.
Figure 13:
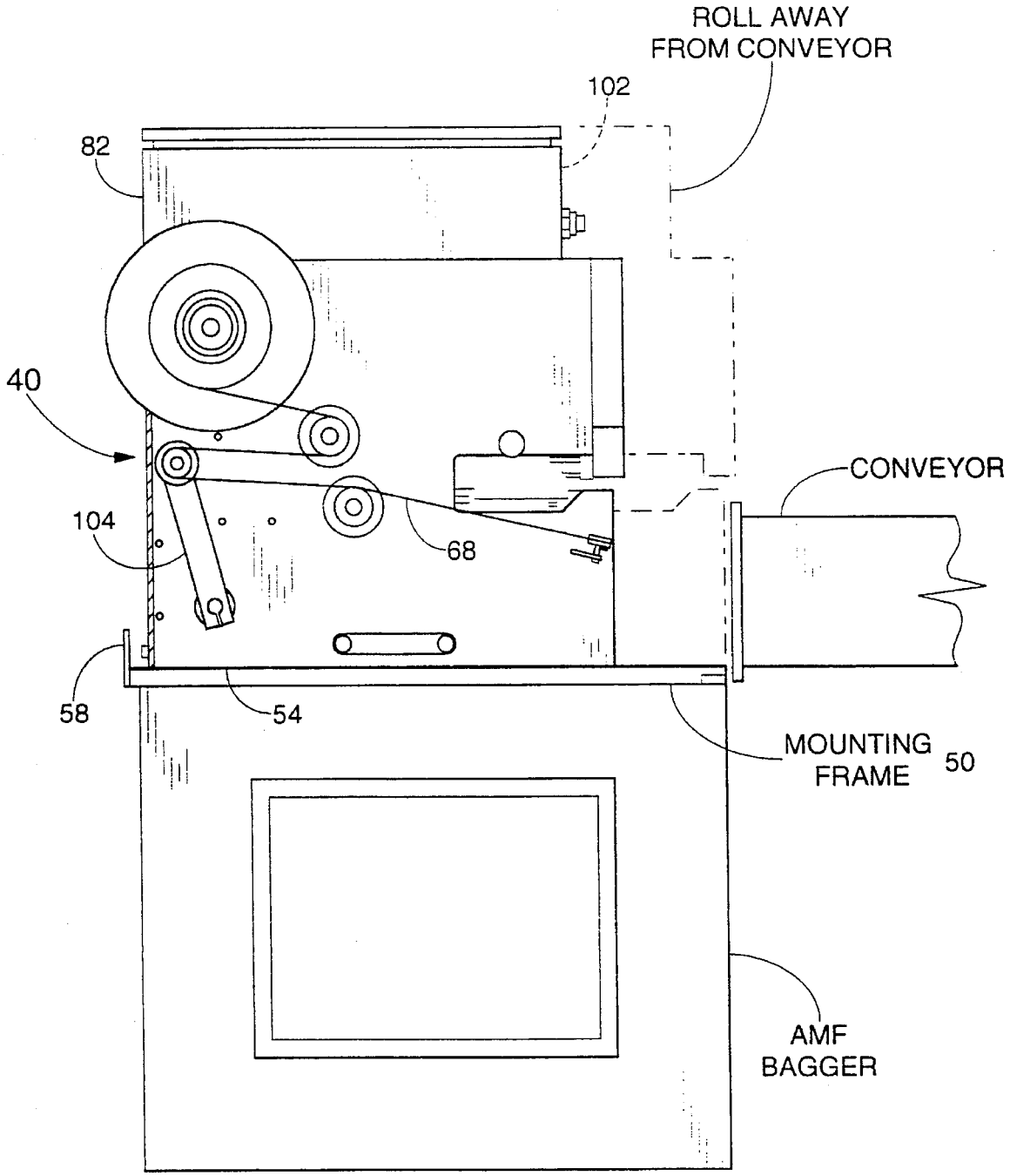
FIG. 13 is an illustration similar to FIG. 12 showing the apparatus of the present invention rolled away from the infeed conveyor.

Push the apparatus 40 back from the conveyor (either by tilting it backward on the stand 42, or by rolling it backward on the mounting frame 50.) See FIGS. 12 and 16.

Insert the length of loose ribbon 68 into the slotted opening along the lower front of the apparatus 40, assuring that the ribbon 68 goes over and around the guide pulleys behind the lower front plates. See FIG. 14.

Slide the ribbon through the slot in the tip of the needle 72 (FIG. 15) so that the ribbon 68 lays over the white plastic roller inside the tip of the needle.

Pull out about a foot of ribbon beyond the shear 76/anvil 74, holding the ribbon 68 so that it is stretched from the tip of the needle 72 to a point below and beyond the shear 76 and anvil 74 (see FIG. 16).

Figure 17:
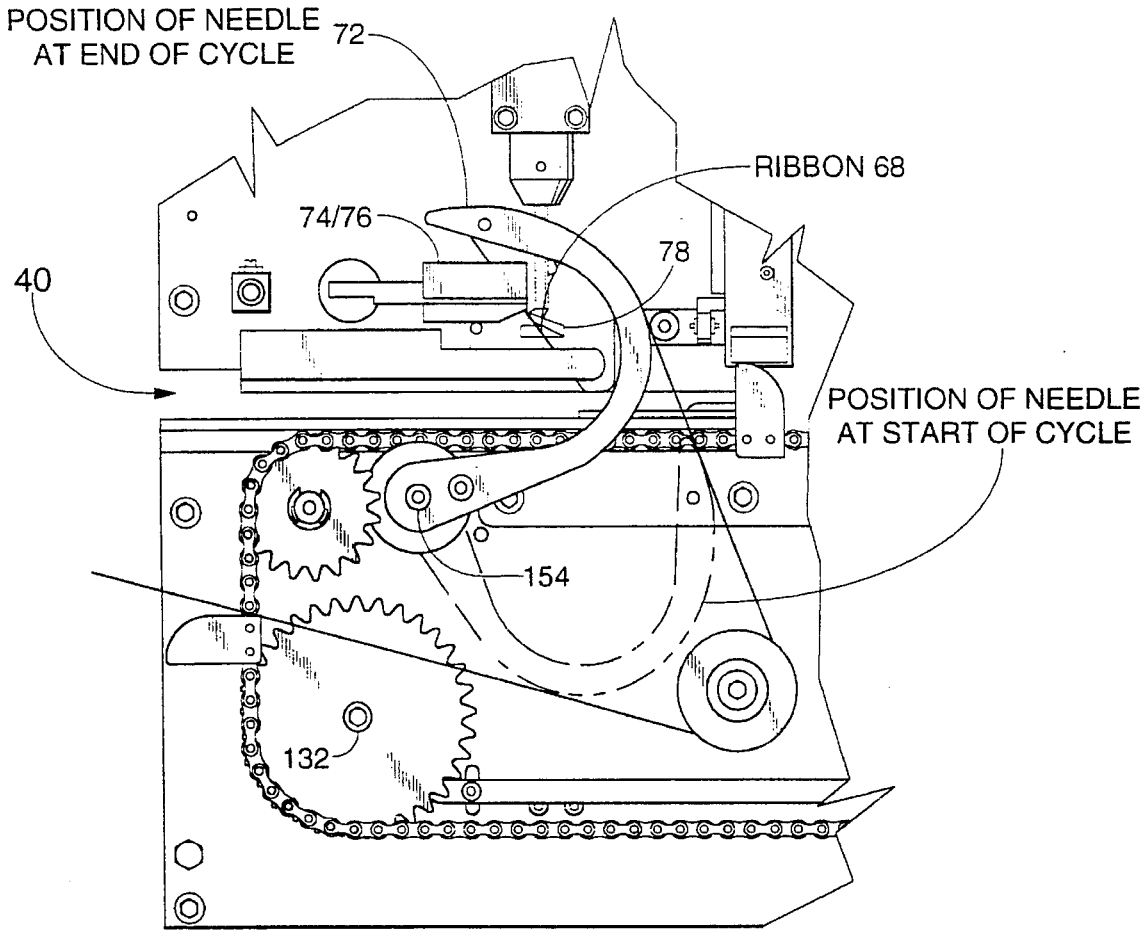
FIG. 17 is an illustration of the component parts of the apparatus of the present invention as the ribbon is threaded therethrough.
Figure 18:
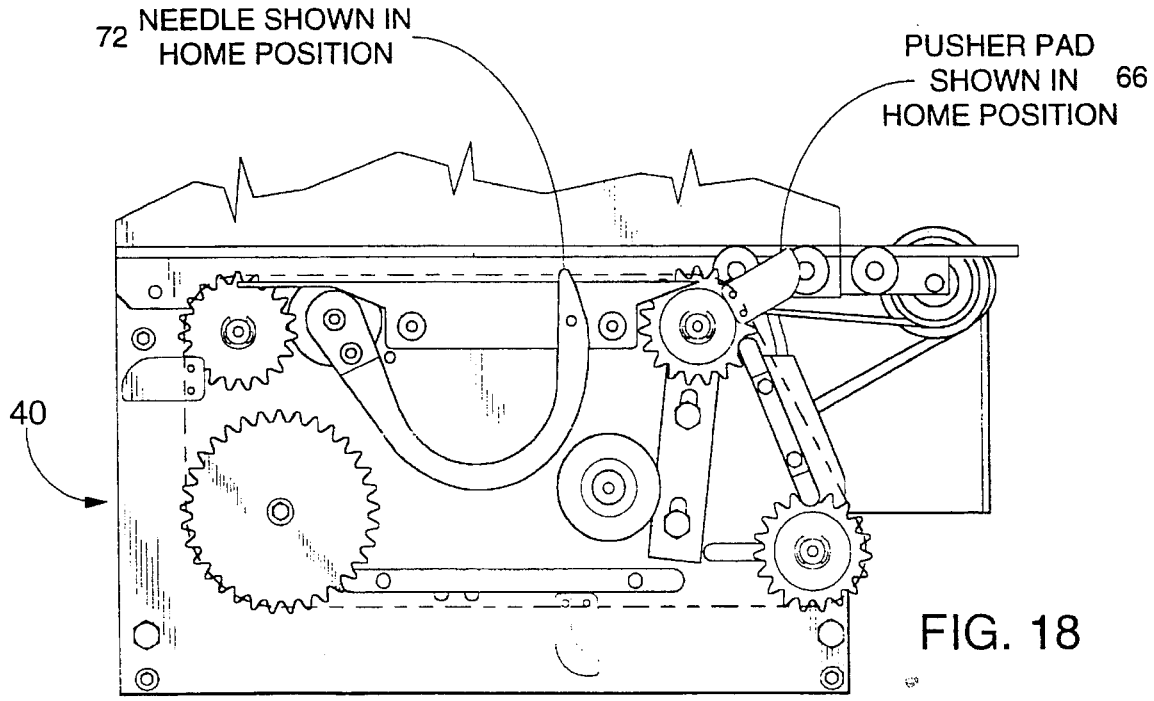
FIG. 18 is an enlargement illustrating various operating components of the apparatus of the present invention.

While holding the free end of the ribbon 68, depress the jog button 90 with the opposite hand. The apparatus 40 will execute one cycle, in which the needle 72 will unwind about four additional inches of ribbon 68 from the spool, carrying the ribbon 68 up into the anvil 74 beside the shear 76. The shear 76 will cut off the ribbon you are holding, and clamp the 'new' free end between the shear 76 and anvil 74. See FIG. 17.

If the apparatus 40 is mounted on the mounting frame 50, roll the apparatus 40 forward toward the conveyor until its wheels drop into the detentes 56. If mounted on the stand 42, pull the apparatus 40 back into its upright position. The apparatus 40 is now ready to tie.

TYING OPERATIONS

With appropriately colored ribbon 68 on the spool and threaded in, the apparatus 40 is ready to tie products. When the PHOTO-OPTIC BAG PRESENT SENSOR 65 (FIG. 28) detects a bag entering the infeed rollers, a tieing cycle is initiated and completed about ½ second later, when the bagged, tied product is allowed to again be carried solely by the conveyor.

The PLC 102 is contained within the control box 82 and serves to monitor and regulate all of the functions of the apparatus 40. This is particularly true of the various sensors comprising the apparatus 40, which in turn regulate operation of the apparatus in a rapid, precise and accurate manner.

Figure 37A:
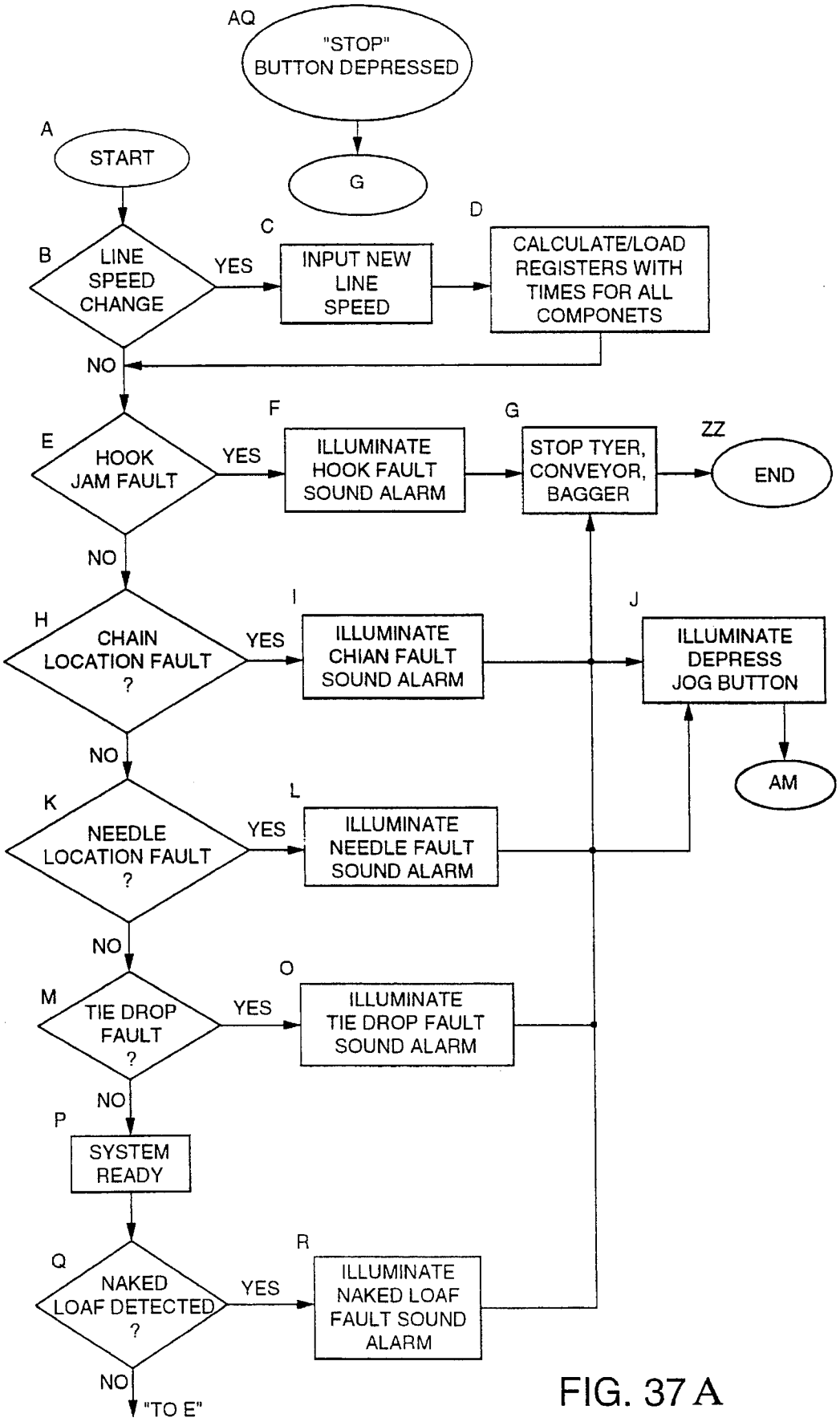
FIG. 37A is a flow chart describing the operating sequence and parameters of the apparatus of the present invention.
Figure 37B:
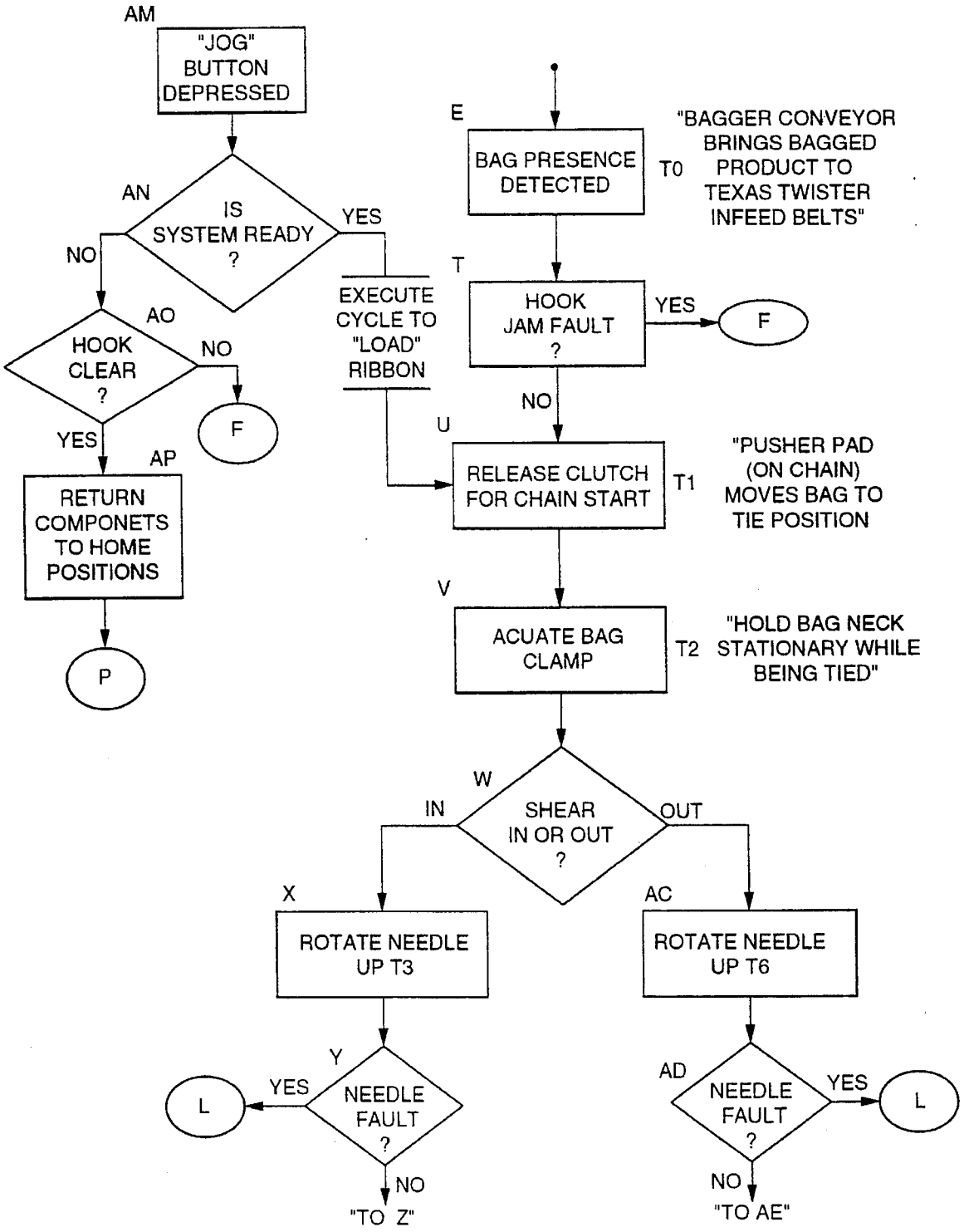
FIG. 37B is a continuation of FIG. 37A, which is a flow chart describing the operating sequence and parameters of the apparatus of the present invention.
Figure 37C:
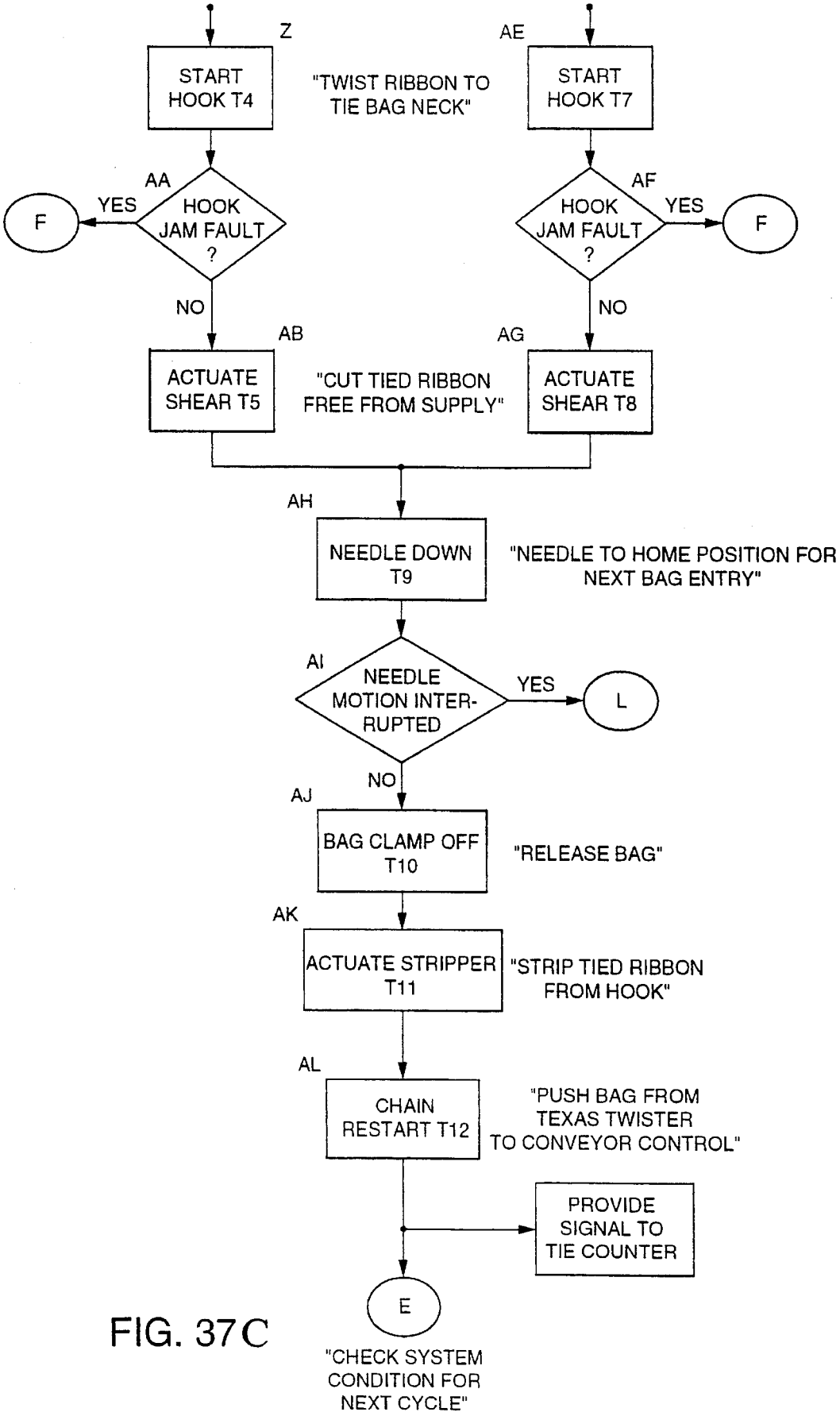
FIG. 37C is a continuation of FIG. 37B, which is a flow chart describing the operating sequence and parameters of the apparatus of the present invention.

The operation of the apparatus 40 is further described in the flow chart comprising FIG. 37 wherein each step in the operation of the apparatus is fully described. FIGS. 37A, B and C further describes the timing sequence which characterizes the operation of the apparatus 40. Finally, FIGS. 37A, B and C describes the operation of all of the various sensors which are utilized to control the operation of the apparatus 40 and to prevent operation thereof in the event of a fault.

Although preferred embodiments of the invention have been illustrated in the Drawings and described in the foregoing Detailed Description, it will be understood that the invention is not limited to the embodiments disclosed, but is capable of numerous rearrangements and variations of its component parts without departing from the spirit of the invention.

I claim:

1. Apparatus for applying twist ties to film wrappers of bakery products including loaves of bread comprising:

means for sequentially receiving an open end of the film wrappers having bakery products contained therein and wherein each film wrapper has a trailing edge;

means for detecting the trailing edge of each film wrapper as the wrapper enters the apparatus;

means for severing a leading end of a length of ribbon to form a twist tie;

means for wrapping the ribbon around the open end of the film wrapper, thereby closing same and wherein the means for wrapping ribbon includes a twister hook;

naked loaf detection means for detecting an unwrapped bakery product;

hook jam detection means for detecting any debris left on the wrapping means;

programmable logic controller means responsive to the trailing edge detection means for initiating operation of the apparatus and for terminating operation of the apparatus in response to the detection of either an unwrapped bakery product or a hook jam.

2. The apparatus as described in claim 1, further comprising means defining a path of travel of the film wrappers through the apparatus; and wherein the trailing edge detection means comprises a photosensor positioned adjacent to the path of travel for detecting film wrappers moving therealong.

3. The apparatus as described in claim 2, wherein the naked loaf detector comprises a photosensor for detecting the presence of objects located adjacent to the path of travel through the apparatus, and wherein the programmable logic controller is responsive to the detection by the naked loaf detector photosensor of an object adjacent to the path of travel through the apparatus and to the failure of the trailing edge detection means to detect the trailing edge of the wrapper to generate a fault signal and to terminate operation of the apparatus.

4. The apparatus described in claim 1, wherein the hook jam detection means includes:

a fiber optic light source for directing a light beam in the vicinity of the twister hook;

a fiber optic photosensor for receiving the light beam generated by the fiber optic light source; and wherein the programmable logic controller is responsive to a failure of the fiber optic photosensor to receive the light beam from the fiber optic light source during a predetermined portion of the operating cycle of the apparatus to generate a fault signal and to terminate operation of the apparatus.

* * * * *